US011823829B2

(12) United States Patent
Oga et al.

(10) Patent No.: US 11,823,829 B2
(45) Date of Patent: Nov. 21, 2023

(54) COIL COMPONENT, ELECTRONIC DEVICE, AND COIL COMPONENT MANUFACTURING METHOD

(71) Applicant: TAIYO YUDEN CO., LTD., Tokyo (JP)

(72) Inventors: Tetsuya Oga, Tokyo (JP); Katsuyuki Horie, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 568 days.

(21) Appl. No.: 16/996,770

(22) Filed: Aug. 18, 2020

(65) Prior Publication Data

US 2021/0065967 A1 Mar. 4, 2021

(30) Foreign Application Priority Data

Aug. 30, 2019 (JP) ..... 2019-158349

(51) Int. Cl.

| | |
|---|---|
| ***H01F 27/29*** | (2006.01) |
| ***H01F 41/10*** | (2006.01) |
| ***H01F 17/04*** | (2006.01) |
| ***H01F 27/28*** | (2006.01) |

(52) U.S. Cl.

CPC ..... *H01F 27/292* (2013.01); *H01F 17/045* (2013.01); *H01F 27/2828* (2013.01); *H01F 41/10* (2013.01)

(58) Field of Classification Search

CPC .. H01F 27/292; H01F 17/045; H01F 27/2828; H01F 41/10

See application file for complete search history.

(56) References Cited

U.S. PATENT DOCUMENTS

| | | | | |
|---|---|---|---|---|
| 2006/0267719 | A1 | 11/2006 | Yasuda et al. | |
| 2011/0279211 | A1 | 11/2011 | Miura et al. | |
| 2015/0042436 | A1* | 2/2015 | Arimitsu | H01F 27/292 336/192 |
| 2015/0084731 | A1* | 3/2015 | Takagi | H01F 19/08 336/212 |

(Continued)

FOREIGN PATENT DOCUMENTS

| | | | |
|---|---|---|---|
| JP | 2005310868 | A | * 11/2005 |
| JP | 2007-005769 | A | 1/2007 |
| JP | 2011-243686 | A | 12/2011 |

*Primary Examiner* — Marlon T Fletcher
*Assistant Examiner* — Malcolm Barnes
(74) *Attorney, Agent, or Firm* — Stein IP, LLC

(57) ABSTRACT

[Problem] To prevent peeling of a terminal electrode from a base portion and to improve precision in assembling a terminal electrode on a base portion.

[Solution] Provided is a coil component comprising: a base portion having a first surface and a second surface connected to the first surface, a first virtual plane including the first surface and a second virtual plane including the second surface intersecting at an obtuse first angle; a coil portion formed by a conductor wound around the base portion; and a first terminal electrode connected electrically to the coil portion, the terminal electrode being made of a plate-shaped first metal plate having a first portion fixed to the first surface of the base portion by a first bonded portion, and a second portion bent towards the first portion and coming into contact at the leading end with the second surface of the base portion.

14 Claims, 20 Drawing Sheets

(56) References Cited

U.S. PATENT DOCUMENTS

| | | | | |
|---|---|---|---|---|
| 2017/0194085 | A1* | 7/2017 | Takagi | H01F 27/29 |
| 2017/0316874 | A1* | 11/2017 | Igarashi | H01F 27/292 |
| 2018/0012699 | A1* | 1/2018 | Arimitsu | H01F 27/24 |
| 2018/0097497 | A1* | 4/2018 | Kobayashi | H03H 1/0007 |
| 2018/0130597 | A1* | 5/2018 | Komaya | H01F 17/045 |
| 2019/0080834 | A1* | 3/2019 | Someya | H01F 27/292 |
| 2019/0244748 | A1* | 8/2019 | Igarashi | H01F 27/29 |
| 2020/0258678 | A1* | 8/2020 | Igarashi | H01F 17/045 |
| 2020/0335261 | A1* | 10/2020 | Sukegawa | H01F 27/006 |

* cited by examiner

FIG. 6(a)
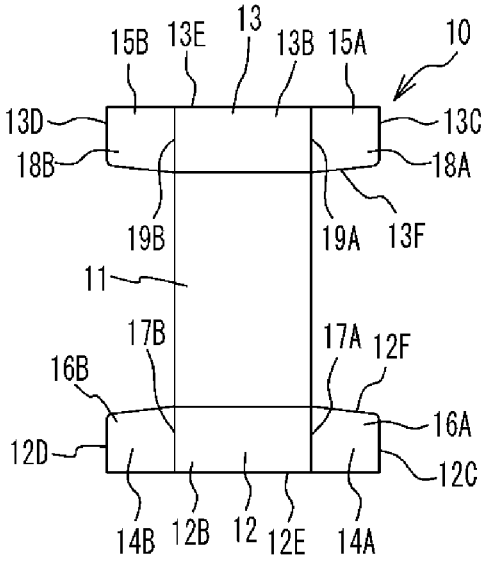
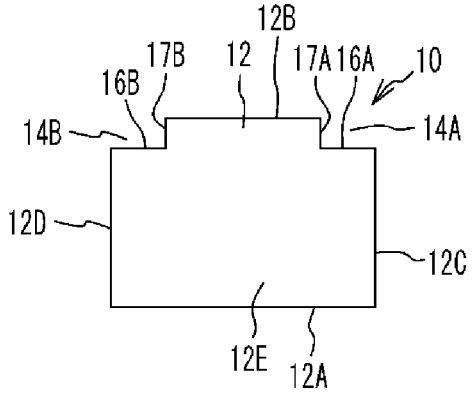
FIG. 6(b)
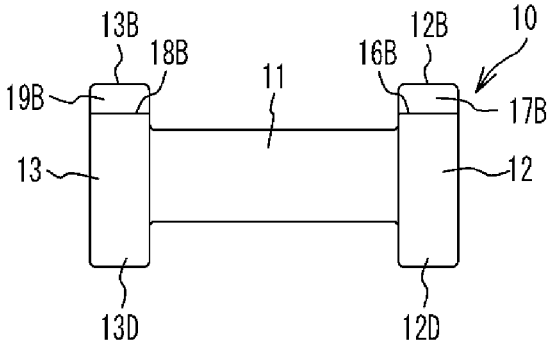
FIG. 6(c)

FIG. 7(a)
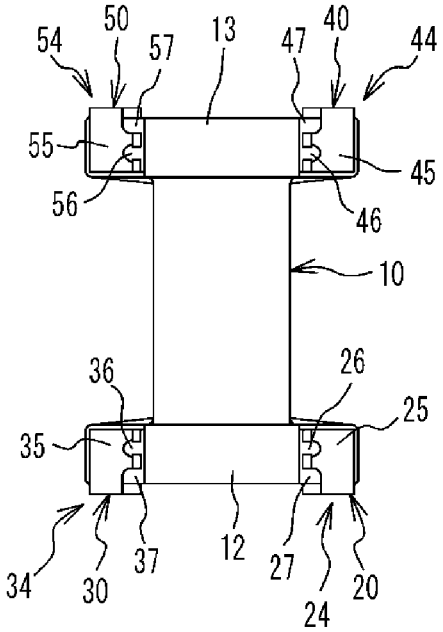
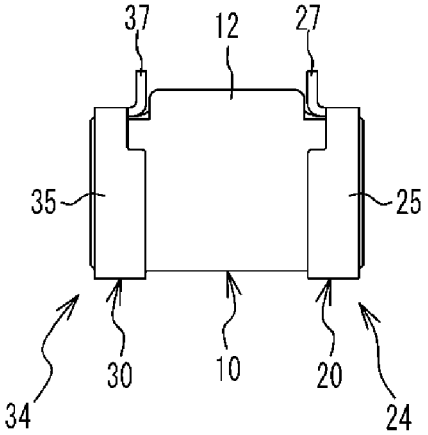
FIG. 7(b)
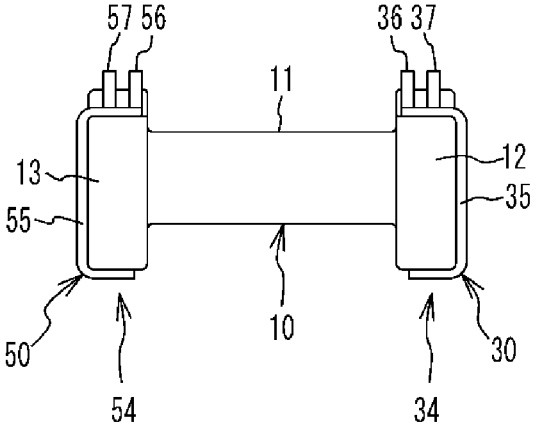
FIG. 7(c)

COIL COMPONENT, ELECTRONIC DEVICE, AND COIL COMPONENT MANUFACTURING METHOD

CROSS-REFERENCE TO RELATED APPLICATIONS

This application claims the benefit of Japanese Application No. 2019-158349, filed Aug. 30, 2019, in the Japanese Patent Office. All disclosures of the document named above are incorporated herein by reference.

TECHNICAL FIELD

The present invention relates to a coil component, an electronic device, and a method for manufacturing a coil component.

BACKGROUND ART

Some coil components are known to have a terminal electrode formed from a metal plate assembled on a base portion. These metal plates are known to have a structure that is fitted into but not fixed to the base portion (such as in Patent Document 1), or a structure that is fixed to the base portion using an adhesive (such as in Patent Document 2).

PRIOR ART LITERATURE

Patent Literature

[Patent Document 1] JP 2007-005769 A
[Patent Document 2] JP 2011-243686 A

SUMMARY OF THE INVENTION

Problem to be Solved by the Invention

Coil components are used, for example, in automobiles, and require good mechanical strength with respect to vibrations. When a metal plate forming a terminal electrode is fitted into but not fixed to a base portion as in Patent Document 1, the mechanical strength of the terminal electrode is reduced. The mechanical strength of a terminal electrode can be improved by fixing a metal plate forming a terminal electrode to a base portion using an adhesive as in Patent Document 2. However, coil components are often subjected repeatedly to temperature fluctuations due to, for example, heat generated by an automobile engine, and the terminal electrode may peel off from the base portion due to the effects of thermal expansion.

As coil components have become progressively smaller, so too have the metal plates forming terminal electrodes. As metal plates have become smaller, the precision required in the assembly of metal plates on base portions has increased.

In view of this problem, it is an object of the present invention to prevent peeling of a terminal electrode from a base portion and to improve precision in assembling a terminal electrode on a base portion.

Means for Solving the Problem

The present invention is a coil component comprising: a base portion having a first surface and a second surface connected to the first surface, a first virtual plane including the first surface and a second virtual plane including the second surface intersecting at an obtuse first angle; a coil portion formed by a conductor wound around the base portion; and a first terminal electrode connected electrically to the coil portion, the terminal electrode being made of a plate-shaped first metal plate having a first portion fixed to the first surface of the base portion by a first bonded portion, and a second portion bent towards the first portion and coming into contact at the leading end with the second surface of the base portion.

This can be configured so that two faces inside the bent portion of the first terminal electrode are two faces facing the first surface and the second surface of the base portion, and a second angle formed by each of the intersecting faces is smaller than the first angle.

This can be configured so that the second portion of the first terminal electrode has a bonded portion connected electrically to the coil portion.

This can be configured so that the first terminal electrode and the base portion have a gap formed between the rear surface area of the face in the second portion of the first terminal electrode provided with at least the bonded portion and the second surface of the base portion.

This can be configured so that the base portion has a notch in the first surface and the second surface in the area overlapping with the first terminal electrode in a corner portion formed by the intersecting first virtual plane and second virtual plane.

This can be configured so that the base portion contains a magnetic material, the first terminal electrode contains copper, and the first bonded portion contains a resin-based adhesive.

This can be configured so that the base portion has a third surface connected to the first surface on the opposite side from the second surface, a third virtual plane including the third surface intersects the first virtual plane, and the first terminal electrode is the first metal plate having a third portion bent toward the first portion on the opposite side from the second portion and coming into contact at the leading end with the third surface of the base portion.

This can be configured so that a third angle formed by the third virtual plane intersecting the first virtual plane is an obtuse angle.

This can be configured so that the base portion has a 3B surface and a 4B surface connected to the 3B surface on the opposite side from the second surface, a 3B virtual plane including the 3B surface intersects a 4B virtual plane including the 4B surface at obtuse angle 3B, and the coil component comprises a second terminal electrode made of a second metal plate having the 3B portion fixed to the 3B surface of the base portion by a second bonded portion, and a 4B portion bent towards the 3B portion and coming into contact at the leading end with the 4B surface of the base portion.

The present invention is also an electronic device comprising a coil component described above, and a circuit board on which the coil component is mounted.

The present invention is also a method for manufacturing a coil component, the method comprising the steps of: preparing a base portion having a first surface and a second surface connected to the first surface, a first virtual plane including the first surface and a second virtual plane including the second surface intersecting at an obtuse first angle; preparing a metal terminal plate having a first portion and a second portion bent toward the first portion; and pressing the base portion against the metal terminal portion to fix the first surface of the base portion to the first portion of the metal terminal plate in the first bonded portion so the leading end of the second portion of the metal terminal plate comes into contact with the second surface of the base portion.

This can be configured so that in the step of preparing the base portion, the base portion has a third surface connected to the first surface on the opposite side from the second surface, and a third virtual plane including the third surface intersects the first virtual plane, in the step of preparing the metal terminal plate, the metal terminal plate has a third portion bent toward the first portion on the opposite side from the second portion, and in the fixing step, the base portion is pressed against the metal terminal portion in the fixing process so the leading end of the third portion of the metal terminal plate comes into contact at the leading end with the third surface of the base portion.

This can be configured so that in the step of preparing the base portion, the base portion is prepared so that the angle formed by the third virtual plane intersecting the first virtual plane is an obtuse angle.

The present invention is also a method for manufacturing a coil component, the method comprising the steps of: preparing a base portion having a first surface, a second surface connected to the first surface, a 3B surface, and a 4B surface connected to the 3B surface on the opposite side from the second surface, a first virtual plane including the first surface and a second virtual plane including the second surface intersecting at an obtuse first angle and a 3B virtual plane including the 3B surface intersecting a 4B virtual plane including the 4B surface at obtuse angle 3B; preparing a frame having a first metal terminal plate having a first portion and a second portion bent toward the first portion, an second metal terminal plate having a 3B portion and a 4B portion bent toward the 3B portion, and a connecting portion connecting the first metal terminal plate and the second metal terminal plate; and pressing the base portion against the frame to fix the first surface of the base portion to the first portion of the first metal terminal plate in a first bonded portion so the leading end of the second portion of the first metal terminal plate comes into contact with the second surface of the base portion, and fixing the 3B surface of the base portion to the 3B portion of the second metal terminal plate in a second bonded portion so the leading end of the 4B portion of the second metal terminal plate comes into contact with the 4B surface of the base portion.

Effects of the Invention

The present invention is able to prevent peeling of a terminal electrode from a base portion and to improve precision in assembling a terminal electrode on a base portion.

BRIEF DESCRIPTION OF THE INVENTION

FIG. 1 is a cross-sectional view of a coil component of the present invention near a terminal electrode.

FIG. 2 (*a*) to FIG. 2 (*c*) are cross-sectional views showing the steps for assembling a metal terminal plate on a base portion in the present invention.

FIG. 6 (*a*) to FIG. 6 (*c*) are side views of the drum core in the first embodiment of the present invention.

FIG. 7 (*a*) to FIG. 7 (*c*) are side views of the metal terminal plate of the coil component in the first embodiment of the present invention.

Figure 8:
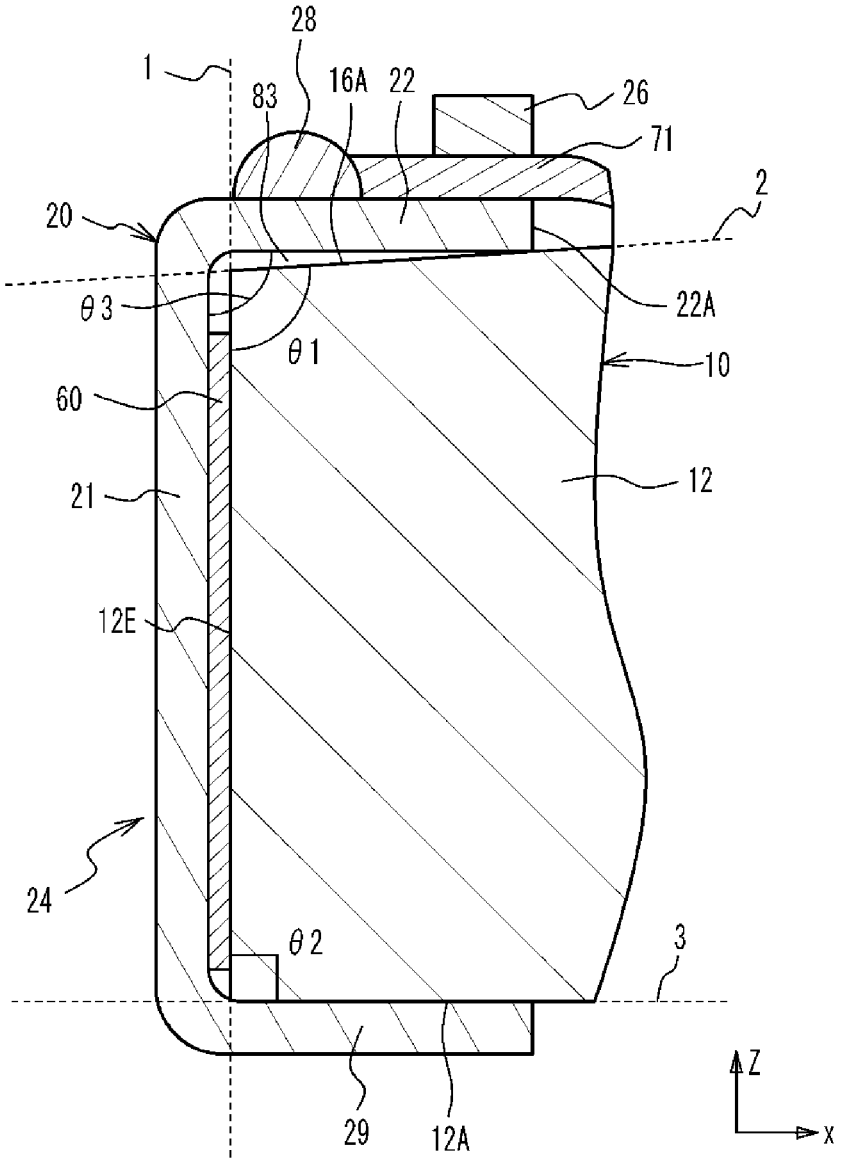

FIG. 8 is a cross-sectional view of the coil component in the first embodiment of the present invention near a terminal electrode.

Figure 9A:
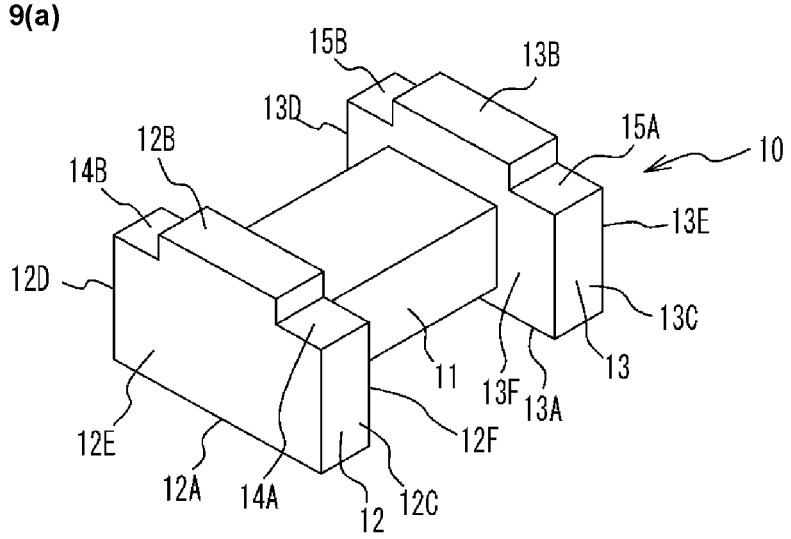
Figure 9B:
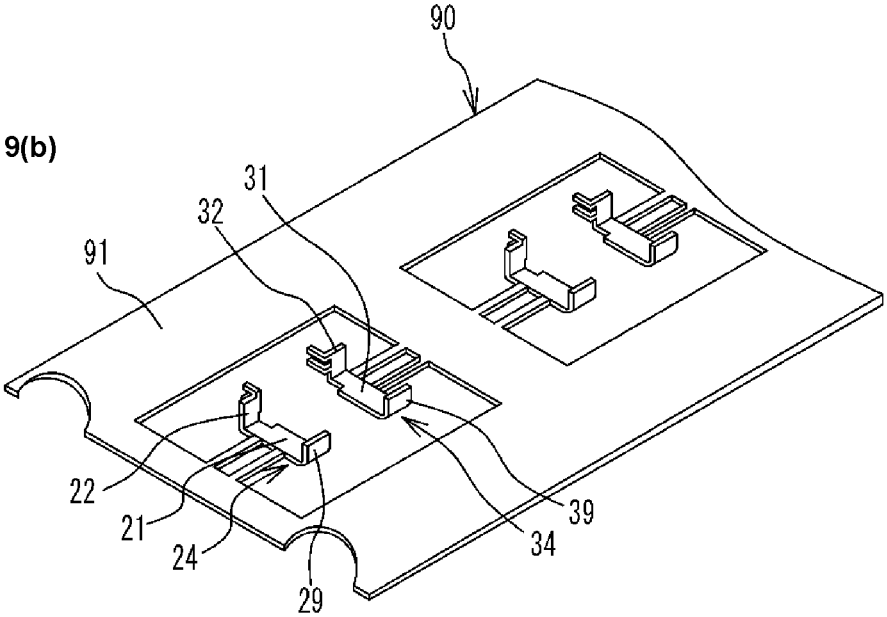

FIG. 9 (*a*) and FIG. 9 (*b*) are diagrams showing the method for manufacturing the coil component in the first embodiment of the present invention (1 of 3).

Figure 10A:
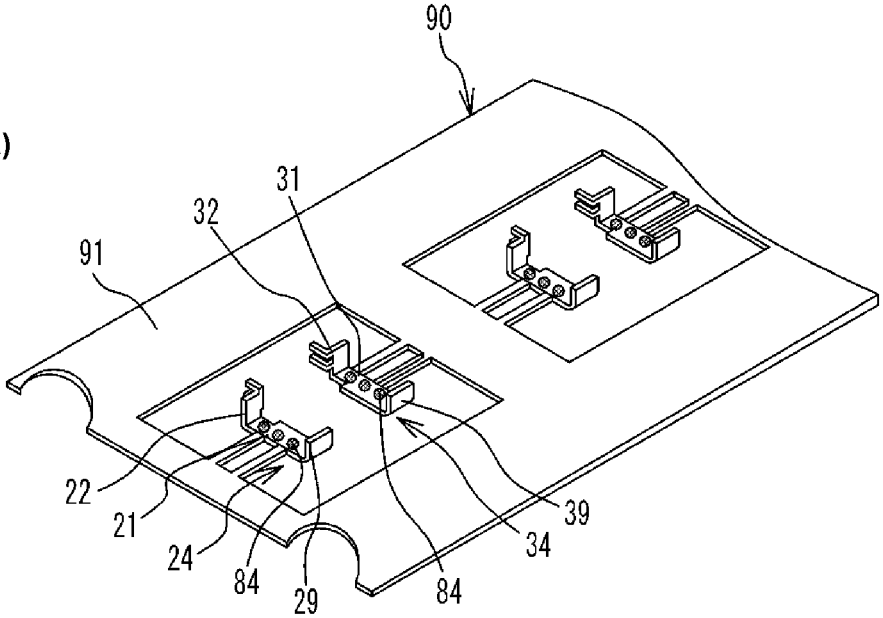
Figure 10B:
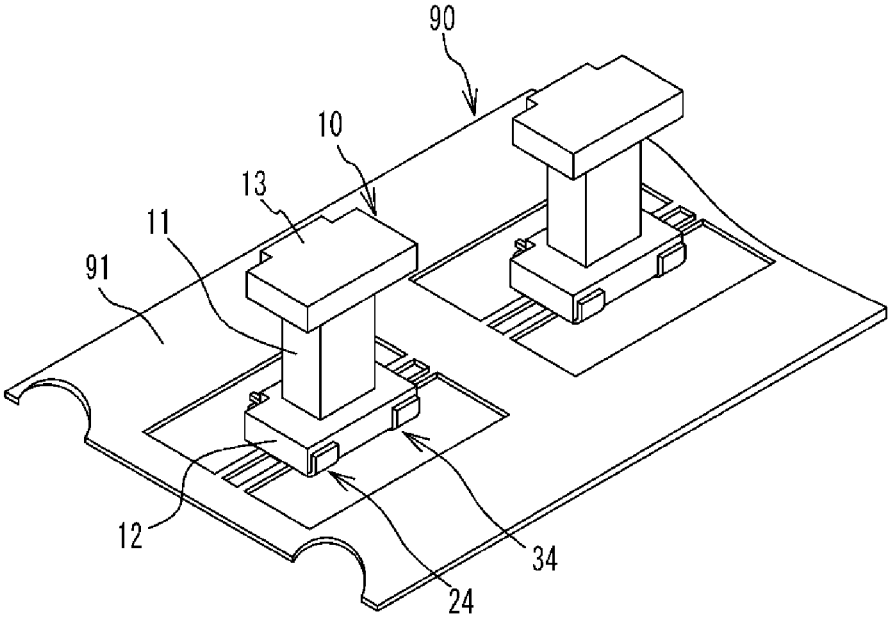

FIG. 10 (*a*) and FIG. 10 (*b*) are diagrams showing the method for manufacturing the coil component in the first embodiment of the present invention (2 of 3).

Figure 11A:
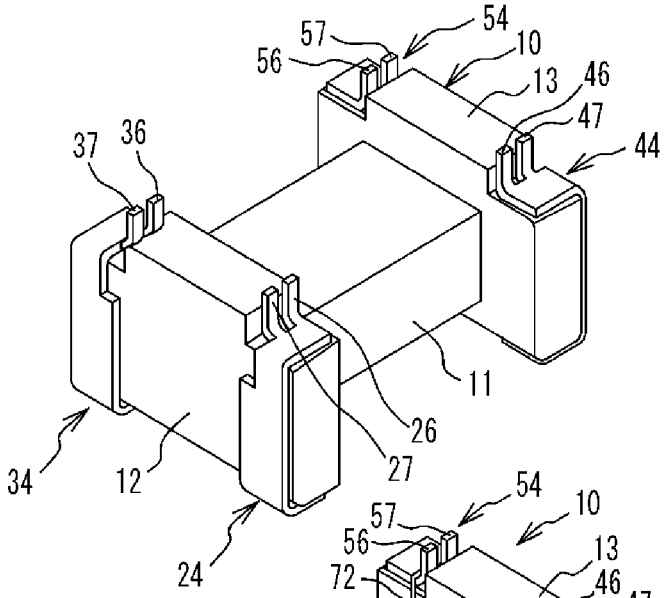
Figure 11B:
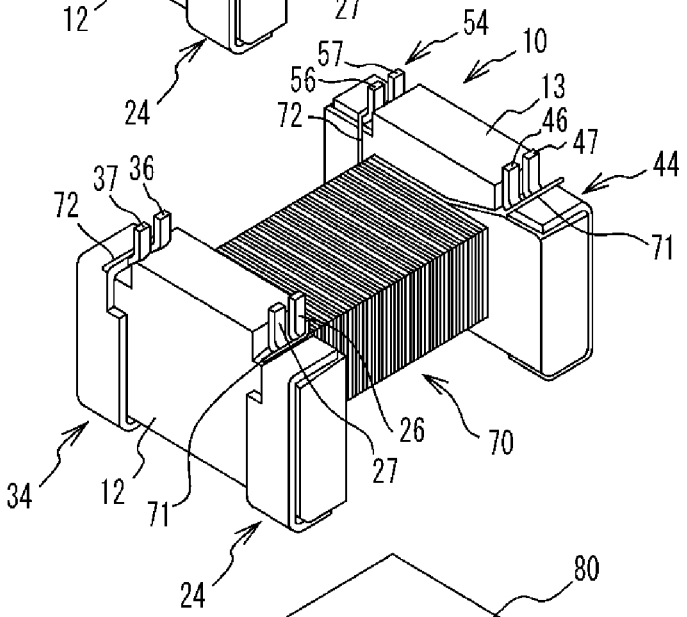
Figure 11C:
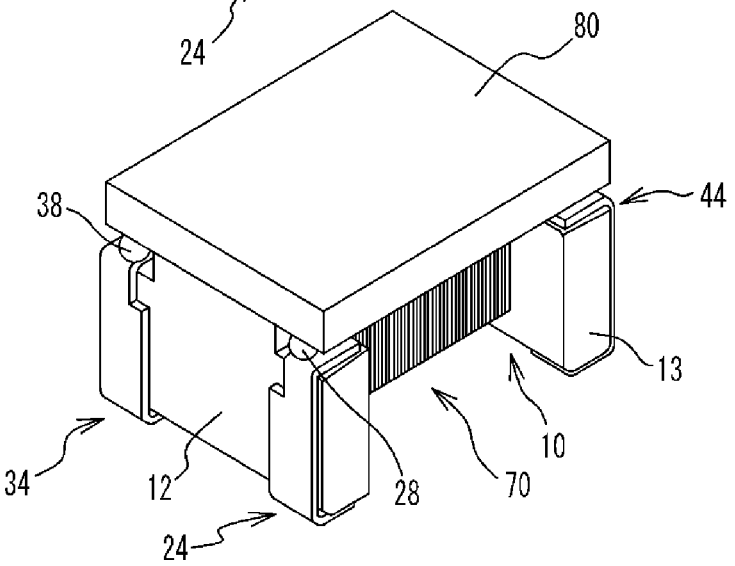

FIG. 11 (*a*) to FIG. 11 (*c*) are diagrams showing the method for manufacturing the coil component in the first embodiment of the present invention (3 of 3).

Figure 12A:
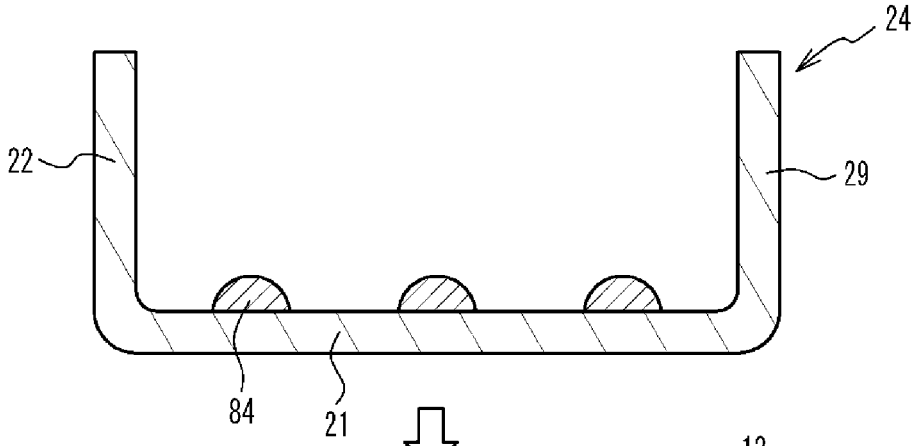
Figure 12B:
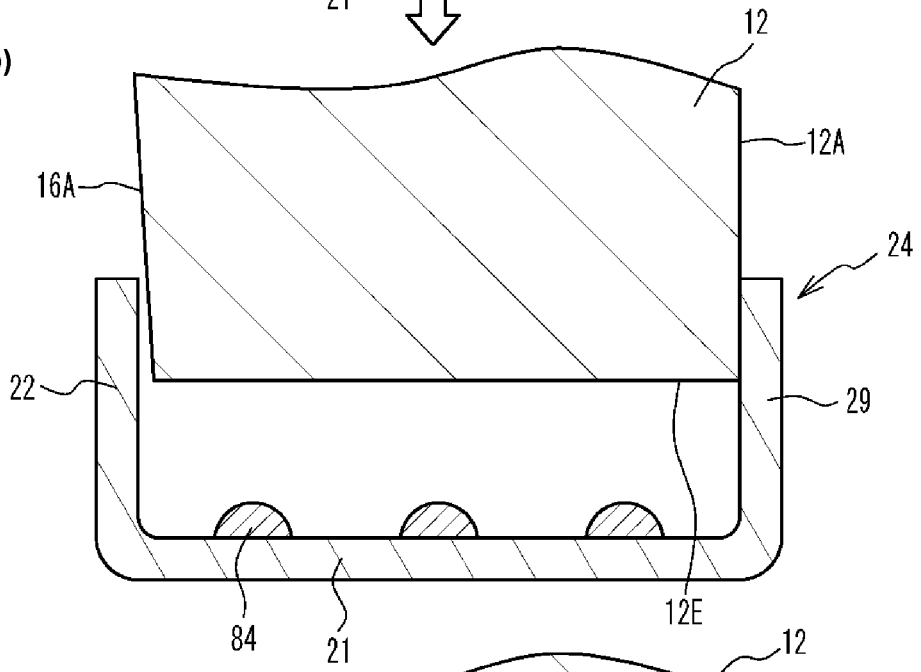
Figure 12C:
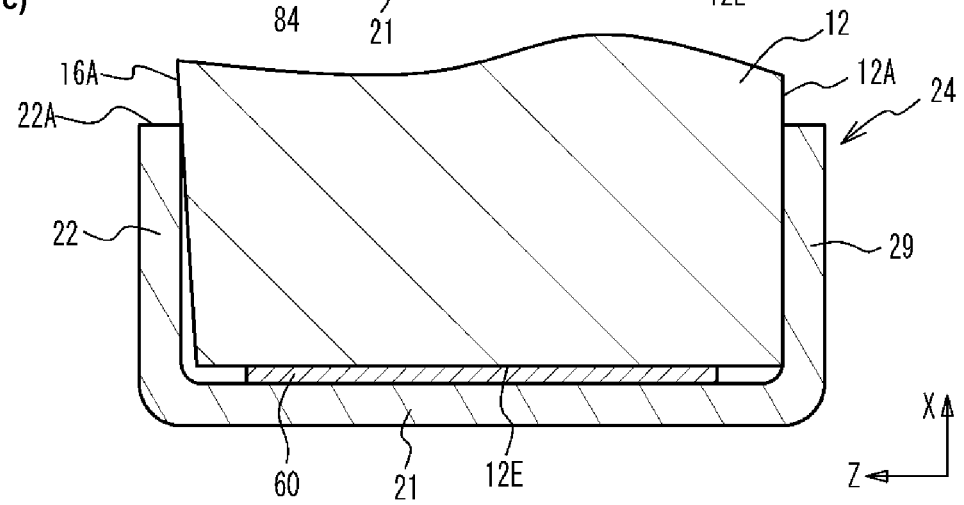

FIG. 12 (*a*) to FIG. 12 (*c*) are cross-sectional views showing the steps for assembling a metal terminal plate on a flange portion in the first embodiment of the present invention.

Figure 13:
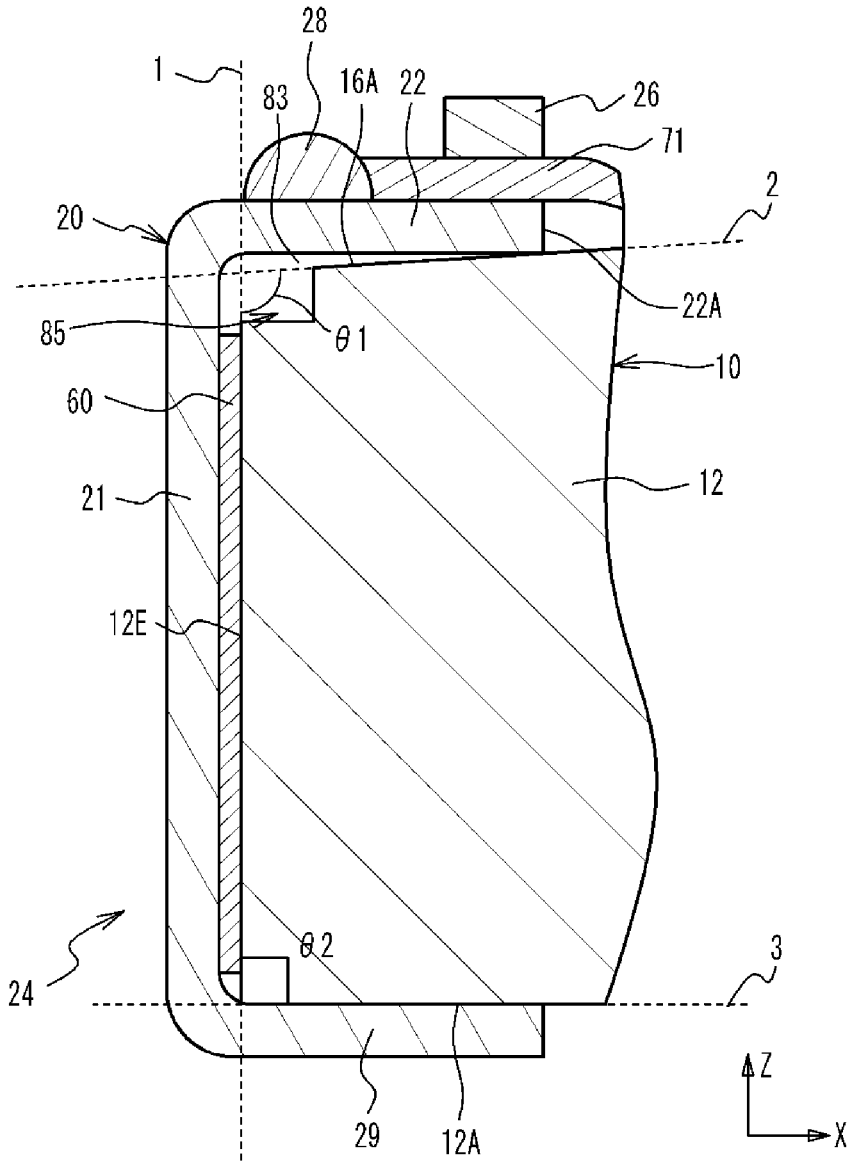

FIG. 13 is a cross-sectional view of the coil component in the second embodiment of the present invention near a terminal electrode.

Figure 14A:
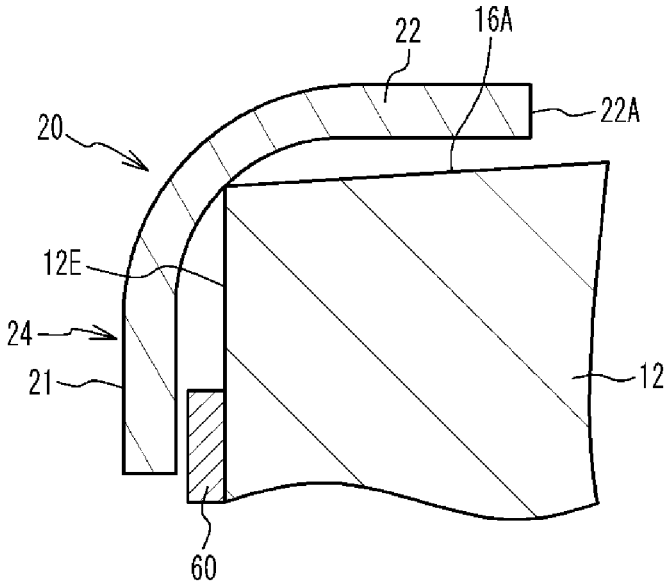
Figure 14B:
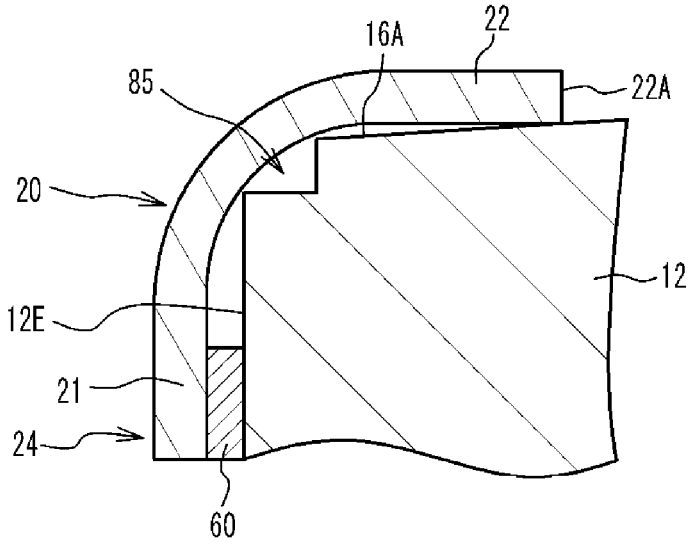

FIG. 14 (*a*) and FIG. 14 (*b*) are diagrams used to explain the effect of the coil component in the second embodiment of the present invention.

Figure 15:
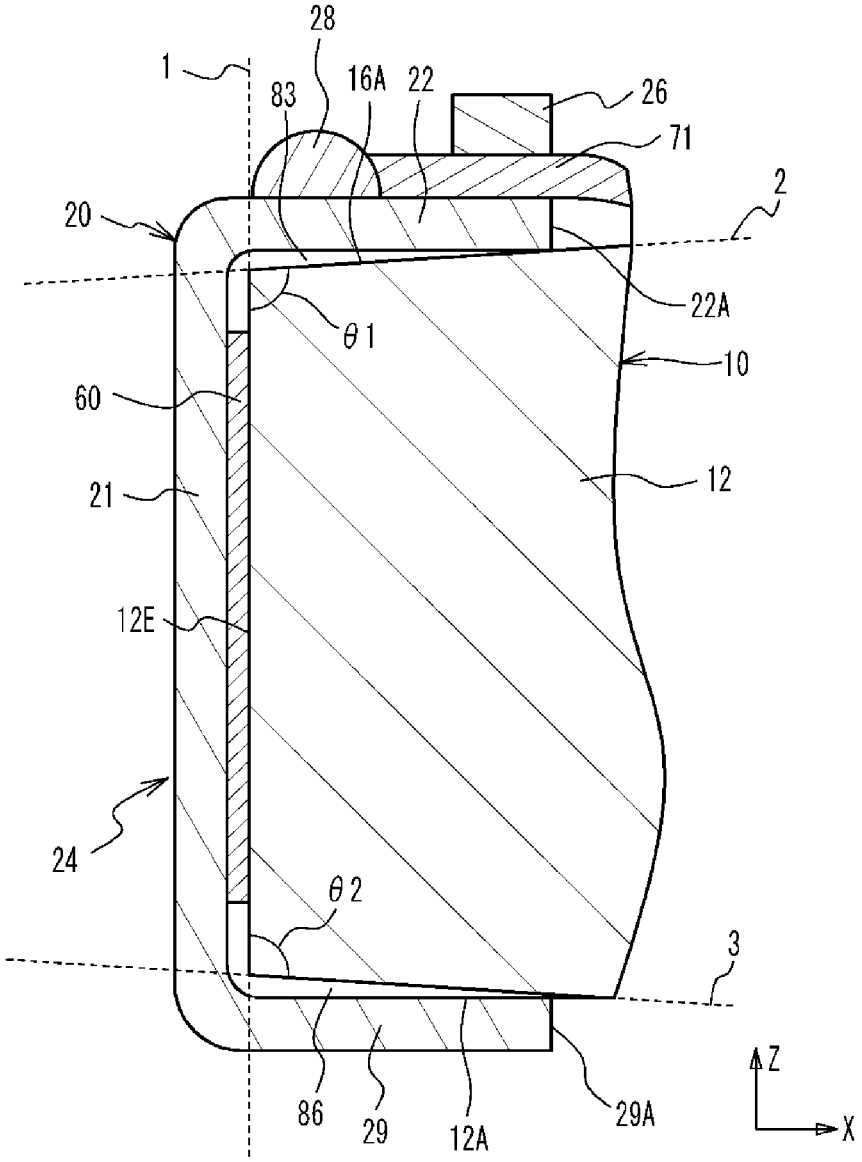

FIG. 15 is a cross-sectional view of the coil component in the third embodiment of the present invention near a terminal electrode.

Figure 16A:
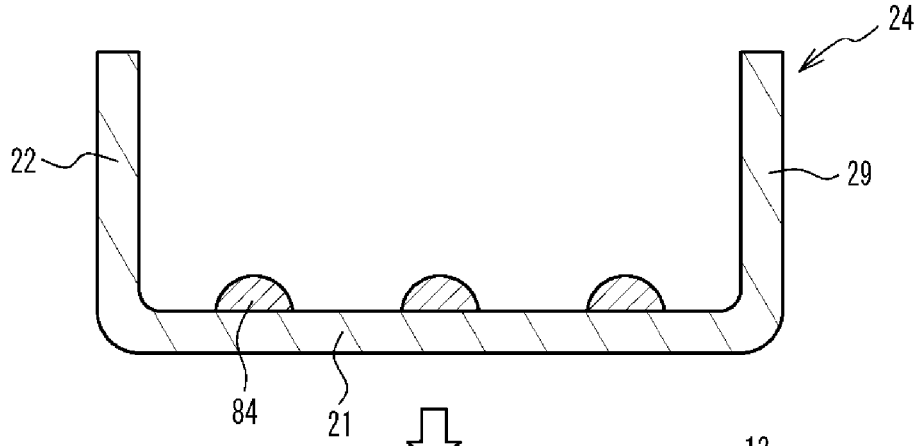
Figure 16B:
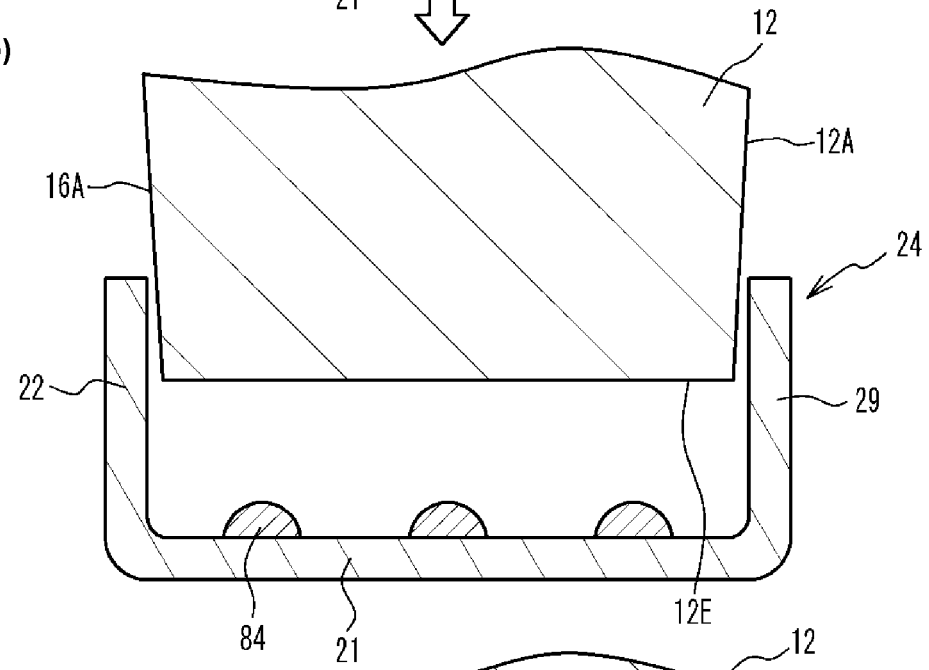
Figure 16C:
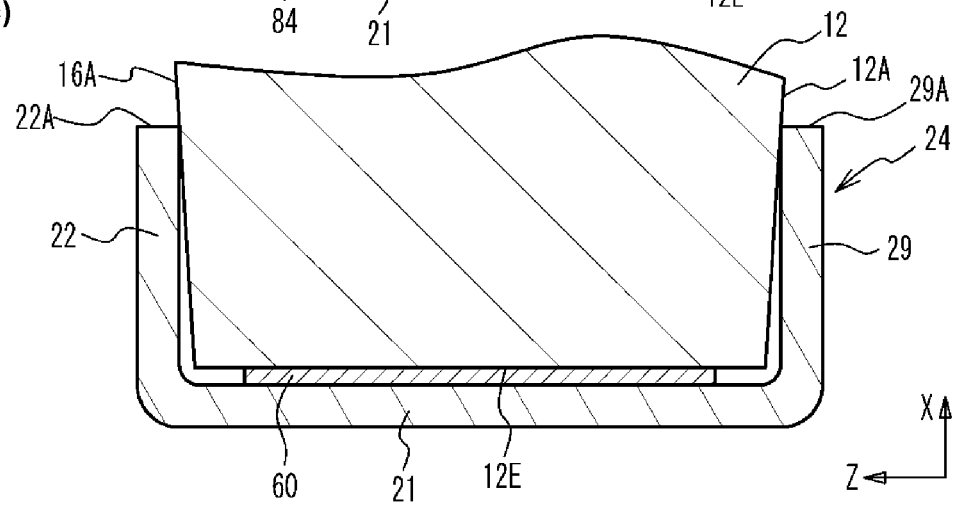

FIG. 16 (*a*) to FIG. 16 (*c*) are cross-sectional views showing the steps for assembling a metal terminal plate on a flange portion in the third embodiment of the present invention.

Figure 17A:
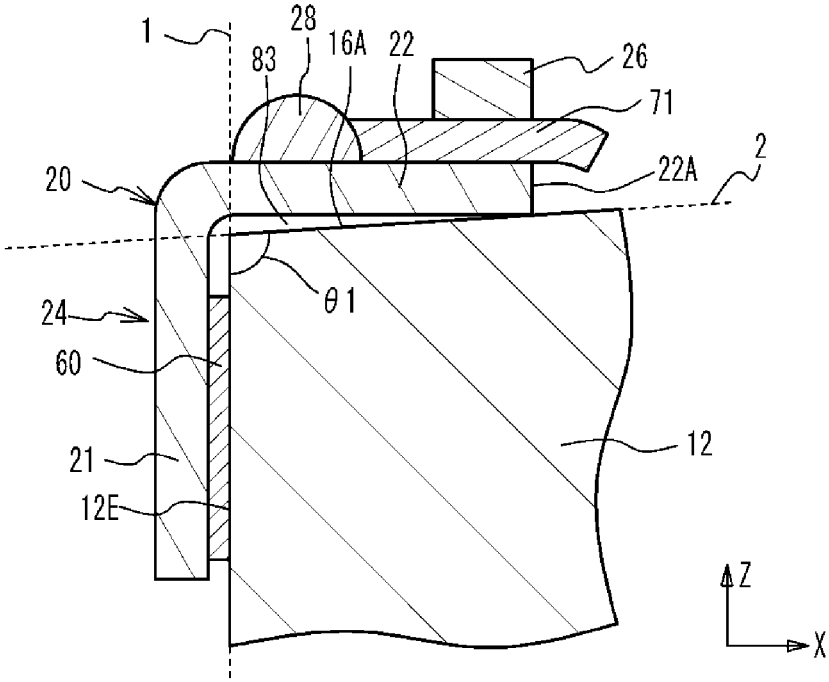
Figure 17B:
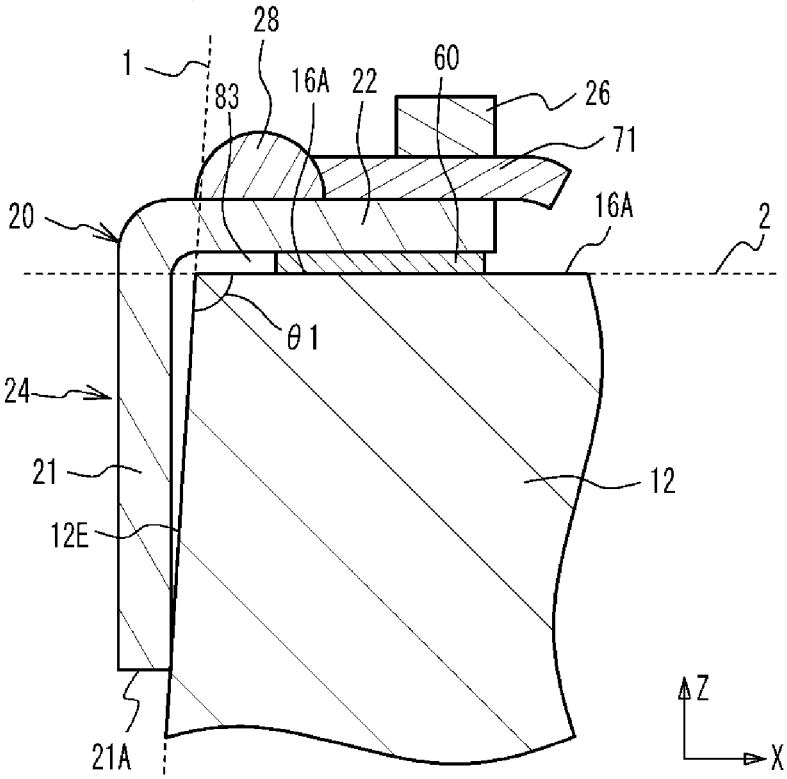

FIG. 17 (*a*) and FIG. 17 (*b*) are cross-sectional views of the coil component in the fourth embodiment of the present invention and a modified example of the same near a terminal electrode.

Figure 18A:
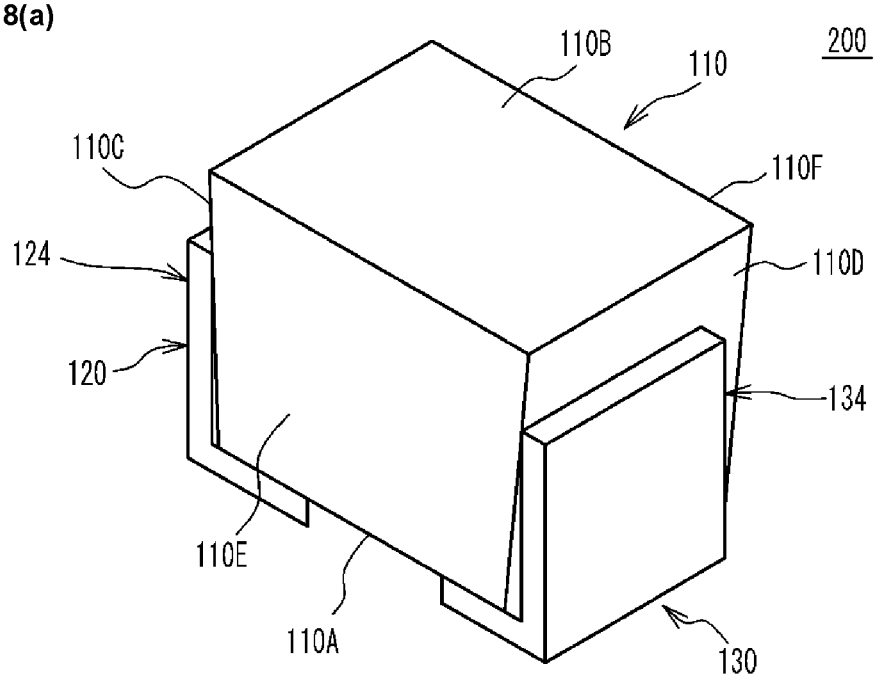
Figure 18B:
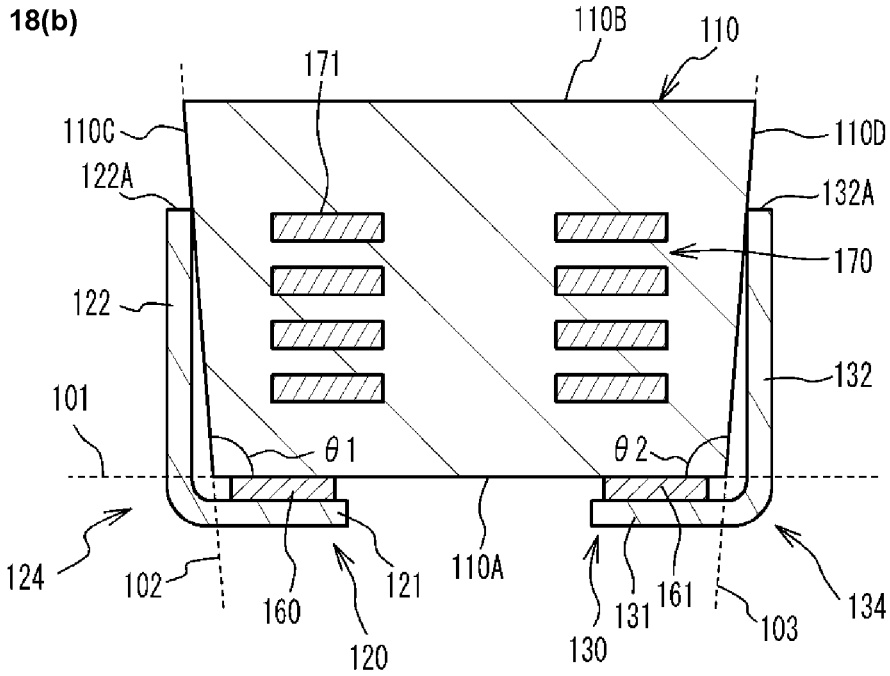

FIG. 18 (*a*) is a perspective view of the coil component in the fifth embodiment of the present invention, and FIG. 18 (*b*) is a cross-sectional view of the coil component in the fifth embodiment of the present invention.

Figure 19A:
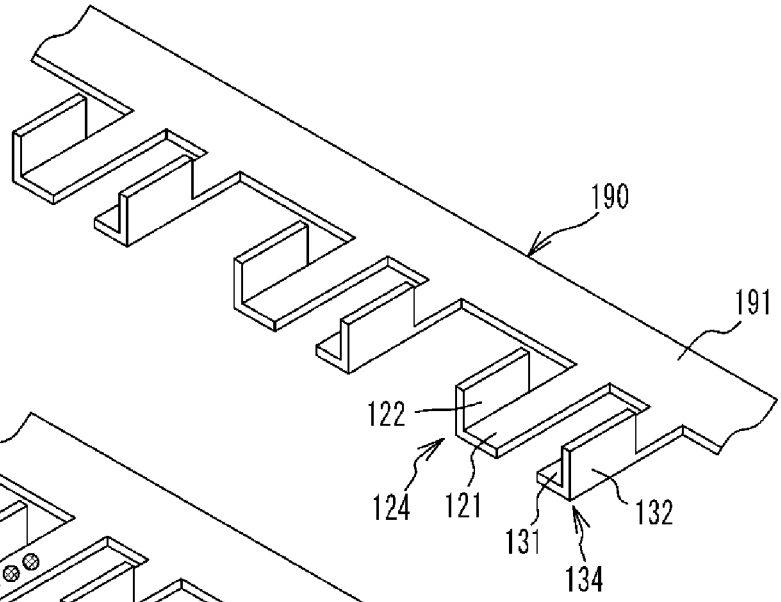
Figure 19B:
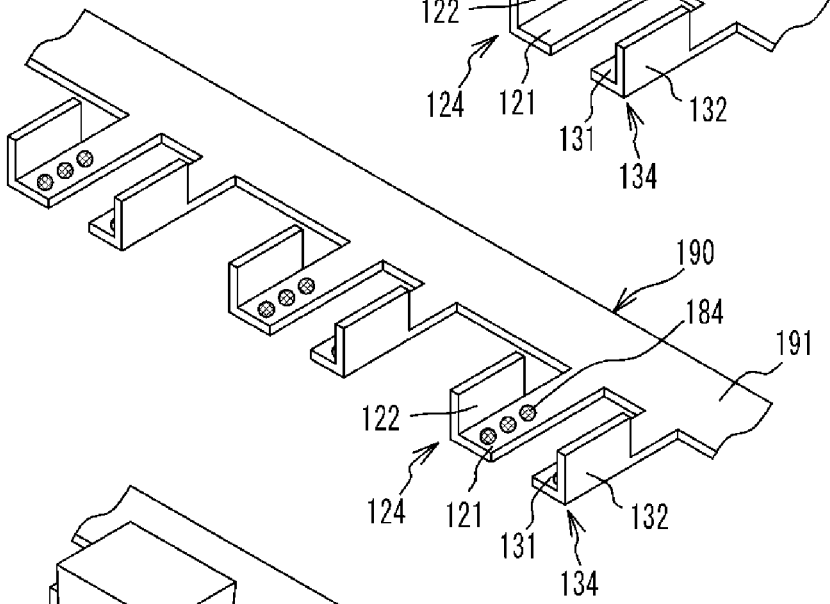
Figure 19C:
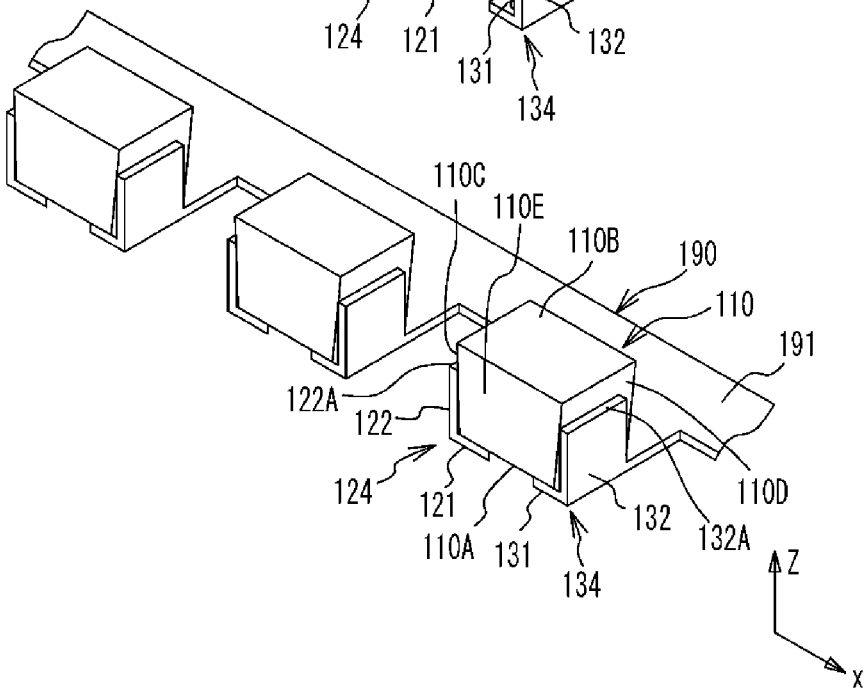

FIG. 19 (*a*) to FIG. 19 (*c*) are diagrams showing the method for manufacturing the coil component in the fifth embodiment of the present invention.

Figure 20:
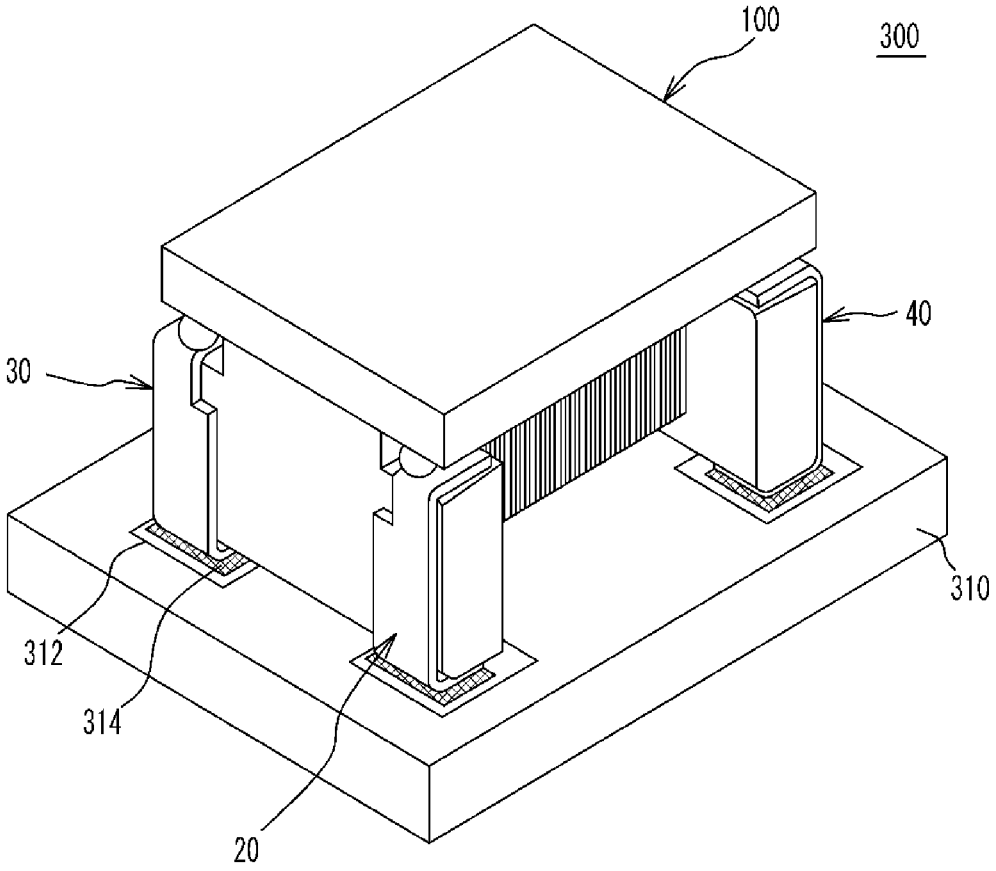

FIG. 20 is a perspective view of an electronic device including the coil component in the first embodiment of the present invention.

EMBODIMENT OF THE INVENTION

Figure 1:
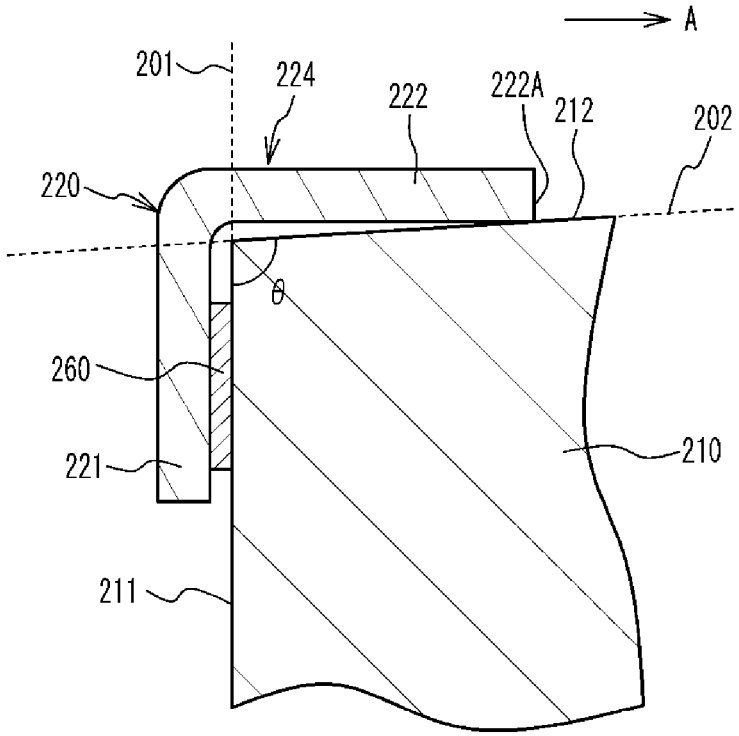

FIG. 1 is a cross-sectional view of a coil component of the present invention near a terminal electrode. As shown in FIG. 1, a terminal electrode 220 is assembled on a base portion 210. The base portion 210 has surface 211 and surface 212. A virtual plane 201 including surface 211 and a virtual plane 202 including surface 212 intersect. Virtual plane 201 including surface 211 and virtual plane 202 including surface 212 means the faces are parallel and overlap, not that portions of the faces make contact and intersect along a line. When a face is included in a virtual plane, it means the faces make contact. (The same applies to the description below.) The terminal electrode 220 is connected electrically to a coil portion (not shown) formed by winding a conductive wire around the base portion 210.

The terminal electrode 220 is made of a metal terminal plate 224 mounted on surface 211 of the base portion 210.

The terminal electrode 220 has a plate-shaped portion 221 along surface 211 of the base portion 210 and a plate-shaped portion 222 bent toward to the plate-shaped portion 221. Here, a plate-shaped portion along a surface of the base portion means a surface of the base portion makes contact with the face of the plate-shaped portion facing the plate-shaped portion or the surface closely parallels the face. (The same applies to the description below.) The plate-shaped portion 221 of the terminal electrode 220 is fixed by a bonded portion 260 to surface 211 of the base portion 210.

The angle θ formed by virtual plane 202 intersecting with virtual plane 201 is an obtuse angle. In other words, the angle θ between virtual plane 201 and virtual plane 202 on the base portion 210 side is an obtuse angle. Plate-shaped portion 221 of the terminal electrode 220 is fixed to surface 211 of the base portion 210 by bonded portion 260, but plate-shaped portion 222 of the terminal electrode 220 is not fixed to surface 212 of the base portion 210. Plate-shaped portion 222 of the terminal electrode 220 makes contact with surface 212 of the base portion 210 at the leading end 222A. In other words, the leading end 222A of plate-shaped portion 222 in the terminal electrode 220 comes into non-fitted and non-bonded contact with surface 212 of the base portion 210. Put another way, the leading end 222A can make movable contact. (The leading end of a terminal electrode making non-fitted and non-bonded contact with a surface of a base portion below means it makes movable contact.) In this way, the leading end 222A of the plate-shaped portion 222 of the terminal electrode 220 maintains contact even though the location of the point of contact with surface 212 is always changing slightly in response to dimensional changes caused by thermal expansion and contraction of surface 212 of the base portion 210 and temporary changes in position caused by external vibrations.

Figure 2A:
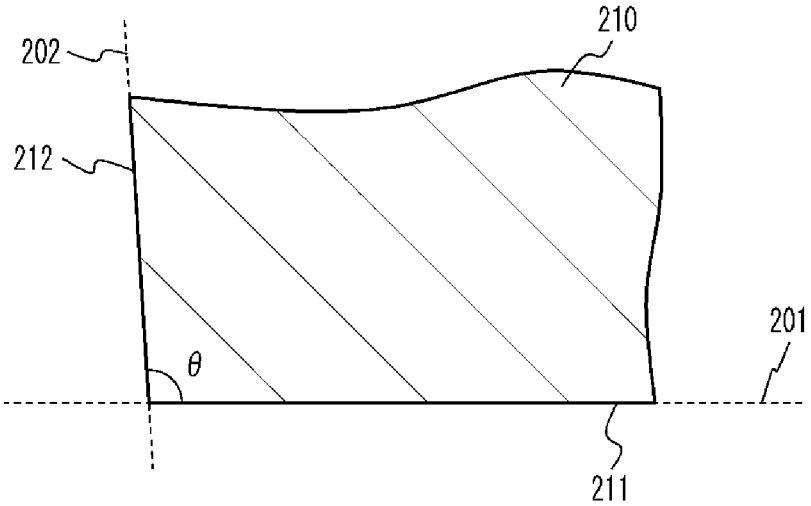
Figure 2B:
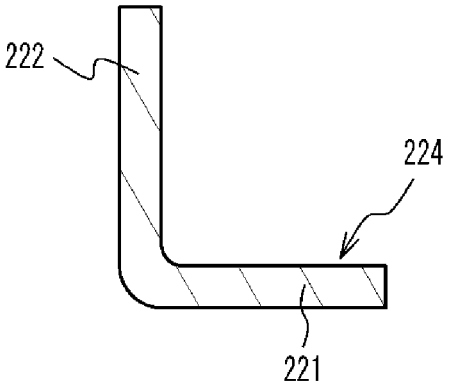
Figure 2C:
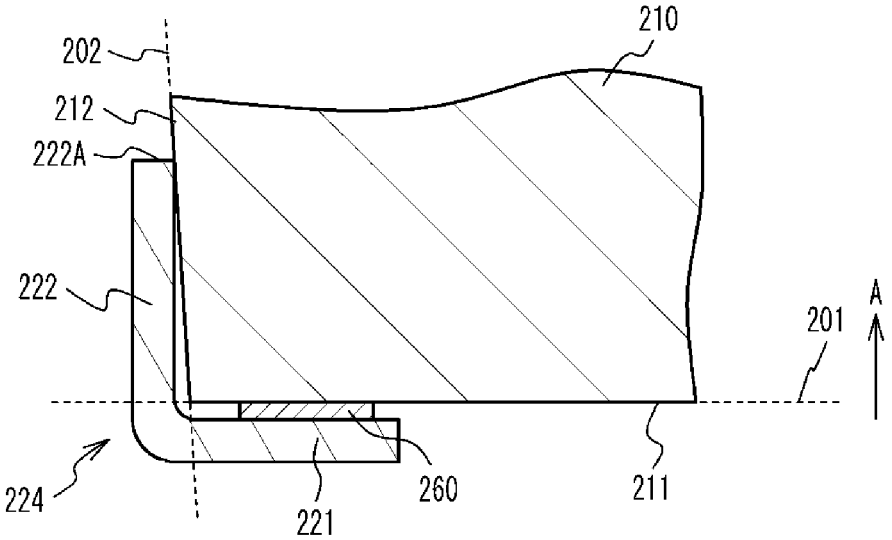

FIG. 2 (*a*) to FIG. 2 (*c*) are cross-sectional views showing the steps for assembling a metal terminal plate on a base portion in the present invention. As shown in FIG. 2 (*a*), a base portion 210 is prepared which has a surface 211 in contact with virtual plane 201 and a surface 212 in contact with virtual plane 202 intersecting virtual plane 201. The angle θ formed by virtual plane 202 intersecting with virtual plane 201 is an obtuse angle.

As shown in FIG. 2 (*b*), a metal terminal plate 224 is prepared which has a plate-shaped portion 221 and another plate-shaped portion 222 bent towards plate-shaped portion 221.

As shown in FIG. 2 (*c*), the base portion 210 is pressed against the metal terminal plate 224 until the leading end 222A of plate-shaped portion 222 of the metal terminal plate 224 comes into contact with surface 212 of the base portion 210. Plate-shaped portion 221 of the metal terminal plate 224 is fixed by a bonded portion 260 to surface 211 of the base portion 210 with the leading end 222A of plate-shaped portion 222 of the metal terminal plate 224 making contact with surface 212 of the base portion 210.

Figure 3A:
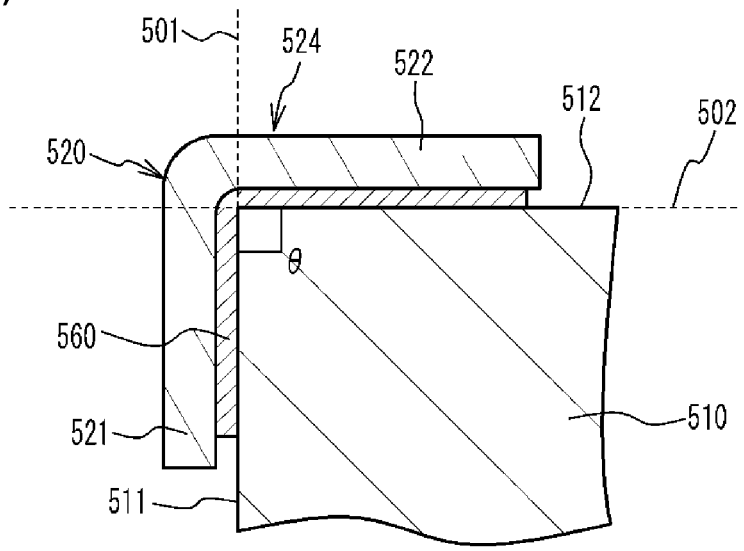
FIG. 3 (*a*) is a cross-sectional view of a coil component in a first comparative example near a terminal electrode, and FIG. 3 (*b*) is a cross-sectional view of a coil component in a second comparative example near a terminal electrode.
Figure 3B:
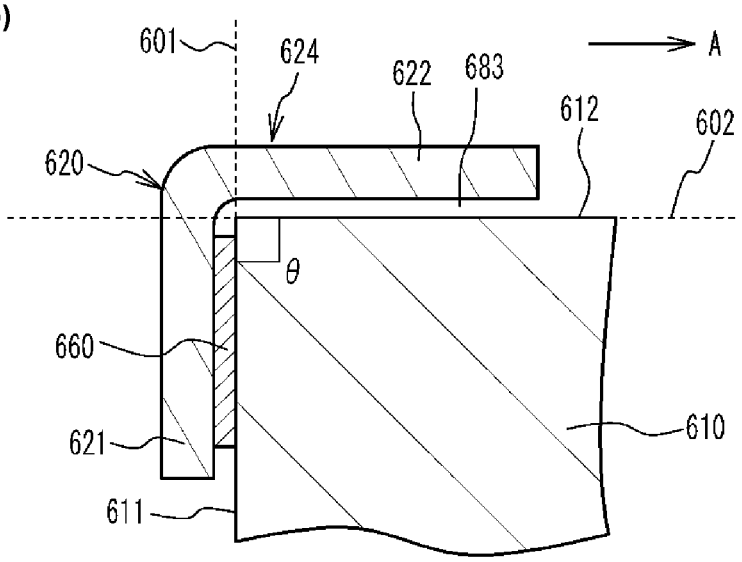

FIG. 3 (*a*) is a cross-sectional view of a coil component in a first comparative example near a terminal electrode. As shown in FIG. 3 (*a*), the angle θ between virtual plane 501 and virtual plane 502 is a right angle. Terminal electrode 520 is a metal terminal plate 524 mounted on surface 511 of the base portion 510 in contact with virtual plane 501 and on surface 512 of the base portion 510 in contact with virtual plane 502. In other words, plate-shaped portion 521 of the terminal electrode 520 is fixed by a bonded portion 560 to surface 511 of the base portion 510 and plate-shaped portion 522 bent toward plate-shaped portion 521 is fixed by a bonded portion 560 to surface 512 of the base portion 510.

In the first comparative example, plate-shaped portion 521 of the terminal electrode 520 is fixed by a bonded portion 560 to surface 511 of the base portion 510 and plate-shaped portion 522 is fixed by a bonded portion 560 to surface 512 of the base portion 510. When the coil component is mounted in an automobile, the automobile engine generates heat which subjects the coil component to an environment in which the temperature is constantly changing. The resin forming the bonded portion 560 usually has a greater coefficient of linear thermal expansion than the metal forming the terminal electrode 520. (For example, the coefficient of linear thermal expansion for an epoxy resin is about $5.9\times10^{-5}$/K and the coefficient of linear thermal expansion for copper is about $1.6\times10^{-5}$/K.) Therefore, when the temperature of the coil component changes, there is a difference in the extent of thermal expansion between the terminal electrode 520 and the bonded portion 560. When the terminal electrode 520 is fixed to both surfaces 511, 512 of the base portion 510, and there is a difference in thermal expansion between the terminal electrode 520 and the bonded portion 560, the terminal electrode 520 may peel off from the bonded portion 560.

FIG. 3 (*b*) is a cross-sectional view of a coil component in a second comparative example near a terminal electrode. As shown in FIG. 3 (*b*), the angle θ between virtual plane 601 and virtual plane 602 is a right angle. Terminal electrode 620 is a metal terminal plate 624 mounted on surface 611 of the base portion 610 in contact with virtual plane 601. In other words, plate-shaped portion 621 of the terminal electrode 620 is fixed by a bonded portion 660 to surface 611 of the base portion 610, but plate-shaped portion 622 bent toward plate-shaped portion 621 is not fixed to surface 612 of the base portion 610. Plate-shaped portion 622 of the terminal electrode 620 is not fixed to surface 612 of the base portion 610, and a gap 683 is formed between plate-shaped portion 622 of the terminal electrode 620 and surface 612 of the base portion 610.

In the second comparative example, plate-shaped portion 621 of the terminal electrode 620 is fixed by a bonded portion 660 to surface 611 of the base portion 610, but plate-shaped portion 622 of the terminal electrode 620 is not fixed to surface 612 of the base portion 610. When the temperature of the coil component changes and there is a difference in thermal expansion between the terminal electrode 620 and the bonded portion 660, the difference is absorbed on the plate-shaped portion 622 side of the terminal electrode 620 and the terminal electrode 620 is kept from peeling off of the bonded portion 660. However, because of the dimensional tolerances of the components constituting the terminal electrode 620, a gap 683 sometimes forms between plate-shaped portion 622 of the terminal electrode 620 and surface 612 of the base portion 610. When plate-shaped portion 622 of the terminal electrode 620 is not in contact with surface 612 of the base portion 610, the position of the terminal electrode 620 with respect to the base portion 610 varies in direction A orthogonal to virtual plane 601 and the assembly precision of the terminal electrode 620 on the base portion 610 declines.

However, in the present invention, as shown in FIG. 1, the angle θ between virtual plane 201 (the first virtual plane) in contact with surface 211 (the first surface) of the base portion 210 and virtual plane 202 (the second virtual plane) in contact with surface 212 (the second surface) is an obtuse angle. Plate-shaped portion 221 (the first portion) of the terminal electrode 220 (the first terminal electrode) is fixed to surface 211 of the base portion 210 by bonded portion 260, and plate-shaped portion 222 (the second portion) of the terminal electrode 220 is not fixed to surface 212 of the base portion 210 but the leading end 222A makes movable contact with surface 212. Therefore, even when the temperature of the coil component changes and there is a significant difference in thermal expansion between the terminal electrode 220 and the bonded portion 260, the difference can be absorbed on the plate-shaped portion 222 side of the terminal electrode 220 and the terminal electrode 220 is kept from peeling off of the bonded portion 260. In other words, the terminal electrode 220 is kept from peeling off of the base portion 210.

Also, as shown in FIG. 2 (*c*), plate-shaped portion 221 (the first portion) of the metal terminal plate 224 (the first metal plate) is fixed to surface 211 of the base portion 210 by a bonded portion 260 with the base portion 210 pressed against the metal terminal plate 224 and the leading end 222A of plate-shaped portion 222 (the second portion) of the metal terminal plate 224 making contact with surface 212 of the base portion 210. Because the leading end 222A of plate-shaped portion 222 of the terminal electrode 220 is making contact with surface 212 of the base portion 210, the position of the metal terminal plate 224 is set with respect to the base portion 210 in direction A orthogonal to virtual plane 201. As a result, the precision with which the terminal electrode 220 is assembled on the base portion 210 can be improved.

The following is a description of embodiments of the present invention with reference to the appropriate figures. Configurational elements shared across figures are denoted by the same reference numbers in all of the figures. Note that the figures are for explanatory purposes only and are not necessarily drawn to scale.

1st Embodiment

Figure 4:
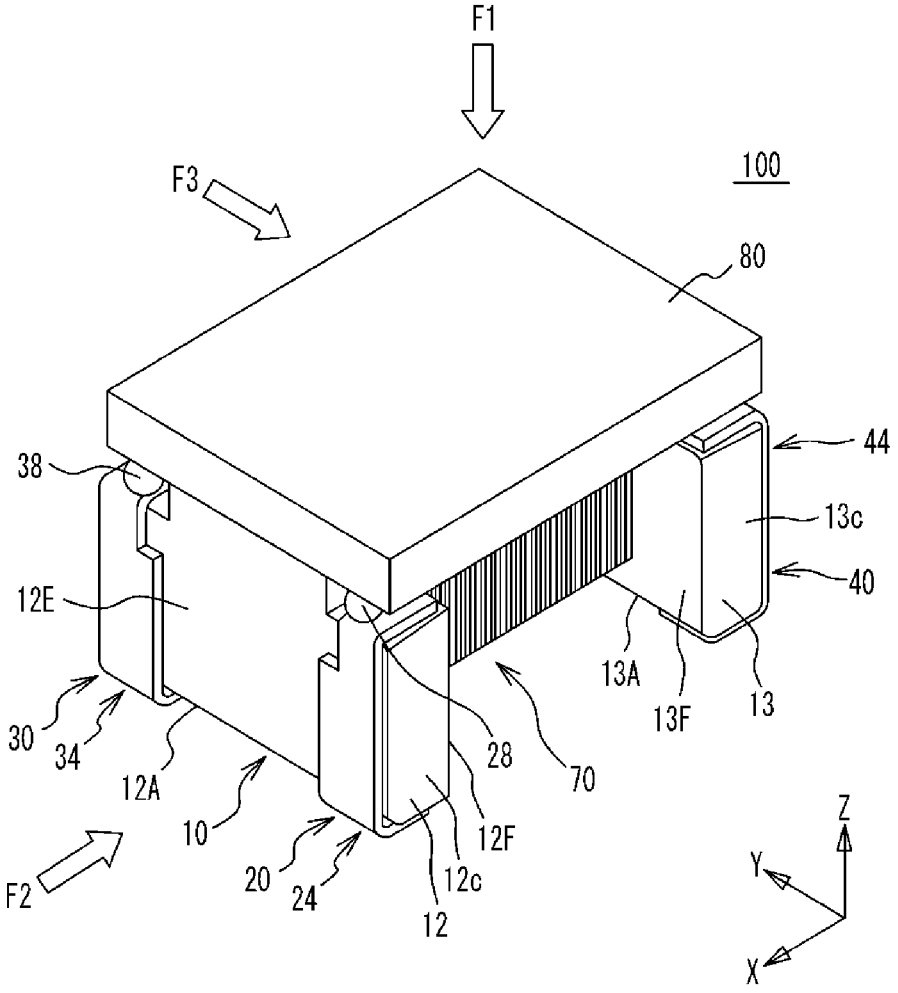
FIG. 4 is a perspective view of the coil component in the first embodiment of the present invention.
Figure 5:
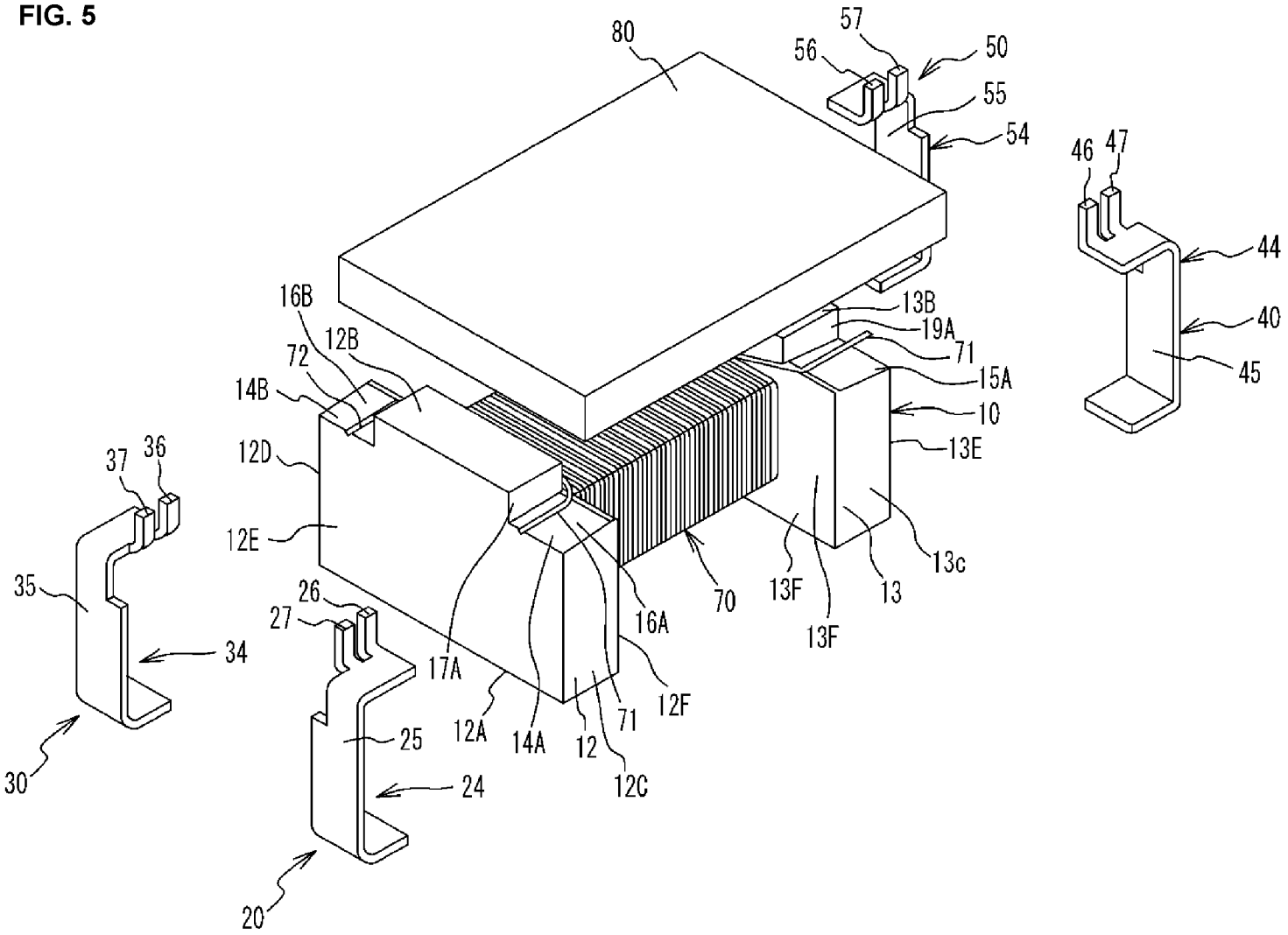
FIG. 5 is an exploded perspective view of the coil component in the first embodiment of the present invention.

The coil component in the first embodiment of the present invention will be explained with reference to FIG. 4, FIG. 5, and FIG. 6 (*a*) to FIG. 6 (*c*). FIG. 4 is a perspective view of the coil component in the first embodiment of the present invention. FIG. 5 is an exploded perspective view of the coil component in the first embodiment of the present invention. In FIG. 5, the conductive wiring and the terminal electrode are not joined. FIG. 6 (*a*) to FIG. 6 (*c*) are side views of the drum core in the first embodiment of the present invention. FIG. 6 (*a*) is a side view of the drum core as viewed from arrow F1 in FIG. 4, FIG. 6 (*b*) is a side view of the drum core as viewed from arrow F2 in FIG. 4, and FIG. 6 (*c*) is a side view of the drum core as viewed from arrow F3 in FIG. 4. The coil component in the present embodiment is a common mode filter, but the present invention is not limited to this type of component.

As shown in FIG. 4, FIG. 5, and FIG. 6 (*a*) to FIG. 6 (*c*), the coil component 100 has a drum core 10, terminal electrodes 20, 30, 40, 50, a coil portion 70, and a plate core 80. The drum core 10 includes a winding core portion 11, a flange portion 12 provided on one end of the winding core portion 11 in the axial direction, and a flange portion 13 provided on the other end of the winding core portion 11 in the axial direction. The winding core portion 11 has a substantially rectangular cross-sectional profile, but may also have a polygonal profile such as that of a hexagon or octagon, or a circular or oval-shaped profile. The flange portions 12, 13 can be cuboid with a recessed portion. The drum core 10 can be made of a Ni—Zn ferrite material, but may also be made of another material. For example, the drum core 10 can be made of a Mn—Zn ferrite material, Fe—Si—Cr-based, Fe—Si—Al-based, or Fe—Si—Cr—Al-based soft magnetic alloy material, magnetic metal material such as Fe or Ni, amorphous magnetic metal material, or nano crystalline magnetic metal material.

The coil component 100 can have, for example, a length of 4.5 mm, a width of 3.2 mm, and a height of 2.8 mm. Here, the length of the coil component 100 is the dimension in the axial direction (X direction in FIG. 4) of the winding core portion 11 of the drum core 10, the width is the dimension in the direction orthogonal to the X direction and parallel to the mounting surface (Y direction in FIG. 4), and the height is the dimension in the direction orthogonal to the X direction and the Y direction (Z direction in FIG. 4). The dimensions of the drum core 10 can be, for example, 4.3 mm in length (the dimension in the X direction in FIG. 4), 3.2 mm in width (the dimension in the Y direction in FIG. 4), and 2.1 mm in height (the dimension in the Z direction in FIG. 4). The winding core portion 11 of the drum core 10 can have, for example, a width (the dimension in the Y direction in FIG. 4) of 1.6 mm and a height (the dimension in the Z direction in FIG. 4) of 1.1 mm. The dimensions of the coil component 100 are not limited to those in the present embodiment and may be smaller. For example, the coil component 100 may be 2.5 mm in length, 1.6 mm in width, and 1.4 mm in height. In other words, the coil component 100 may have a length in a range from 2.5 mm to 4.5 mm, a width in a range from 1.6 mm to 3.2 mm, and a height in a range from 1.4 mm to 2.8 mm. As the external dimensions of the coil component 100 become smaller, the drum core 10 may be set in a range from 2.3 mm to 4.3 mm in length (the dimension in the X direction in FIG. 4), from 1.6 mm to 3.2 mm in width (the dimension in the Y direction in FIG. 4), and from 1.0 mm to 2.1 mm in height (the Z direction in FIG. 4). The winding core portion 11 of the drum core 10 may be set in a range from 0.8 mm to 1.6 mm in width (the dimension in the Y direction in FIG. 4), and from 0.65 mm to 1.1 mm in height (the dimension in the Z direction in FIG. 4). When the dimensions of the coil component 100 are reduced in this way, the dimensions of each portion are also reduced. However, further explanation has been omitted below.

The coil portion 70 includes two conductive wires 71, 72. Conductive wire 71 is wound around the winding core portion 11 and is connected electrically to terminal electrode 20 on one end and connected electrically to terminal electrode 40 on the other end. Conductive wire 72 is wound around the winding core portion 11 and is connected electrically to terminal electrode 30 on one end and connected electrically to terminal electrode 50 on the other end. The conductive wires 71, 72 can consist of a core wire made of copper coated with an insulating coating made of polyamide imide. The core wire may be made of a metal other than copper, such as silver, palladium, or a silver-palladium alloy. Also, the insulating coating may be made of an insulating material other than polyamide imide, such as polyester imide, polyurethane, or another resin material. The diameter of the conductive wires 71, 72 is 0.075 mm, but may be within a range from 0.040 mm to 0.075 mm.

Flange portion 12 has lower face 12A, upper face 12B, end face 12C, end face 12D, side face 12E, and side face 12F. Flange portion 13 has lower face 13A, upper face 13B, end face 13C, end face 13D, side face 13E, and side face 13F. Lower face 12A and lower face 13A face the circuit board when the coil component 100 is mounted on a circuit board. Side face 12F and side face 13F are connected to the winding core portion 11.

Recessed portions 14A, 14B are formed in upper face 12B of flange portion 12. The recessed portions 14A, 14B are formed at both ends of upper face 12B. Bottom face 16A and side face 17A in recessed portion 14A and bottom face 16B and side face 17B in recessed portion 14B are considered part of upper face 12B. Recessed portions 15A, 15B are formed in upper face 13B of flange portion 13. The recessed portions 15A, 15B are formed at both ends of upper face 13B. Bottom face 18A and side face 19A in recessed portion 15A and bottom face 18B and side face 19B in recessed portion 15B are considered part of upper face 13B. Some or all of bottom face 16A of recessed portion 14A and bottom face 16B of recessed portion 14B are at an angle larger than a perpendicular angle to side face 12E. Some or all of bottom face 18A of recessed portion 15A and bottom face 18B of recessed portion 15B are at an angle larger than a perpendicular angle to side face 13E. This angle is omitted from FIG. 4, FIG. 5, and FIG. 6 (*a*) to FIG. 6 (*c*) for illustrative purposes. (The same applies to the figures below.) This angle will be described in detail below with reference to FIG. 8. The thickness of the flange portions 12, 13 can be, for example, 0.7 mm. The depth of the recessed portions 14A, 14B, 15A, 15B can be, for example, 0.3 mm, and the length of the bottom faces can be, for example, 0.7 mm.

Terminal electrodes 20 and 30 are assembled on flange portion 12. Terminal electrodes 40 and 50 are assembled on flange portion 13. Terminal electrode 20 is composed of metal terminal plate 24, and terminal electrode 30 is composed of metal terminal plate 34. Terminal electrode 40 is composed of metal terminal plate 44, and terminal electrode 50 is composed of metal terminal plate 54. Metal terminal plates 24, 34, 44 and 54 can be, for example, phosphor bronze plates plated with tin. They can also be another type of metal plate such as a brass plate plated with tin or a tough pitch copper plate plated with tin.

Metal terminal plate 24 extends from lower face 12A of flange portion 12 via side face 12E to bottom face 16A of recessed portion 14A provided in upper face 12B and is assembled on flange portion 12. Metal terminal plate 34 extends from lower face 12A of flange portion 12 via side face 12E to bottom face 16B of recessed portion 14B provided in upper face 12B and is assembled on flange portion 12. Similarly, metal terminal plate 44 extends from lower face 13A of flange portion 13 via side face 13E to bottom face 18A of recessed portion 15A provided in upper face 13B and is assembled on flange portion 13. Similarly, metal terminal plate 54 extends from lower face 13A of flange portion 13 via side face 13E to bottom face 18B of recessed portion 15B provided in upper face 13B and is assembled on flange portion 13.

FIG. 7 (*a*) to FIG. 7 (*c*) are side views of the metal terminal plate of the coil component in the first embodiment of the present invention. FIG. 7 (*a*) is a side view of the drum core as viewed from arrow F1 in FIG. 4, FIG. 7 (*b*) is a side view of the drum core as viewed from arrow F2 in FIG. 4, and FIG. 7 (*c*) is a side view of the drum core as viewed from arrow F3 in FIG. 4. As shown in FIG. 7 (*a*) to FIG. 7 (*c*), metal terminal plate 24 has metal plate 25, engaging claw 26 extending from metal plate 25, and joining claw 27 extending from metal plate 25 and spaced apart from engaging claw 26. Engaging claw 26 and joining claw 27 are arranged inside recessed portion 14A. Similarly, metal terminal plates 34, 44 and 54 have metal plates 35, 45 and 55, engaging claws 36, 46 and 56, and joining claws 37, 47 and 57. Engaging claw 36 and joining claw 37 are arranged inside recessed portion 14B, engaging claw 46 and joining claw 47 are arranged inside recessed portion 15A, and engaging claw 56 and joining claw 57 are arranged inside recessed portion 15B. Engaging claws 26, 36, 46 and 56 are provided to pinch and secure conductive wire 71 or 72 along with metal plates 25, 35, 45 and 55. The joining claws 27, 37, 47 and 57 are provided to join conductive wire 71 or 72 by welding or some other means to electrically connect conductive wire 71 or 72 to the metal terminal plate 24, 34, 44 and 54.

As shown in FIG. 4 and FIG. 5, one end of conductive wire 71 is joined to joining claw 27 on metal terminal plate 24 by welding or some other means to form a joined portion 28, and conductive wire 71 drawn from coil portion 70 is connected electrically to terminal electrode 20 by the joined portion 28. The other end of conductive wire 71 is joined to joining claw 47 on metal terminal plate 44 by welding or some other means to form a joined portion (not shown), and conductive wire 71 drawn from coil portion 70 is connected electrically to terminal electrode 40 by the joined portion. Similarly, one end of conductive wire 72 is joined to joining claw 37 on metal terminal plate 34 by welding or some other means to form a joined portion 38, and conductive wire 72 drawn from coil portion 70 is connected electrically to terminal electrode 30 by the joined portion 38. The other end of conductive wire 72 is joined to joining claw 57 on metal terminal plate 54 by welding or some other means to form a joined portion (not shown), and conductive wire 72 drawn from coil portion 70 is connected electrically to terminal electrode 50 by the joined portion. The joined portions can be formed, for example, using laser welding or arc welding.

Plate core 80 is fixed to upper face 12B of flange portion 12 and upper face 13B of flange portion 13 by, for example, an adhesive. Plate core 80 can have, for example, a cuboid shape. As in the case of the drum core 10, the plate core 80 can be made of a Ni—Zn ferrite material, but may also be made of another material. For example, as in the case of the drum core 10, the plate core 80 can be made of a Mn—Zn ferrite material, Fe—Si—Cr-based, Fe—Si—Al-based, or Fe—Si—Cr—Al-based soft magnetic alloy material, magnetic metal material such as Fe or Ni, amorphous magnetic metal material, or nano crystalline magnetic metal material.

FIG. 8 is a cross-sectional view of the coil component in the first embodiment of the present invention near a terminal electrode. Note that plate core 80 is not depicted in FIG. 8. (The same applies to the figures below.) Because terminal electrodes 30, 40 and 50 are assembled on the drum core 10 in the same way as terminal electrode 20, a description is provided of terminal electrode 20 only and descriptions of terminal electrodes 30, 40 and 50 have been omitted.

As shown in FIG. 8, side face 12E of flange portion 12 comes into contact with virtual plane 1, bottom face 16A of recessed portion 14A provided on upper face 12B comes into contact with virtual plane 2, and lower face 12A of flange portion 12 comes into contact with virtual plane 3. Virtual plane 1 intersects virtual plane 2, and angle θ1 formed by virtual plane 2 intersecting virtual plane 1 is an obtuse angle. In other words, angle θ1 between virtual plane 1 and virtual plane 2 on the flange portion 12 side is an obtuse angle. Therefore, bottom surface 16A in recessed portion 14A is a tapered surface inclined toward side face 12E. Note that the entire bottom face 16A of recessed portion 14A may be a tapered surface inclined toward side face 12E, or a portion of bottom face 16A may be a tapered surface. Virtual plane 1 intersects virtual plane 3, and angle θ2 formed by virtual plane 3 intersecting the virtual plane is a right angle. Therefore, side face 12E and lower face 12A intersect at a right angle.

Terminal electrode 20 has a plate-shaped portion 21 along side face 12E of flange portion 12, plate-shaped portion 22 bent toward plate-shaped portion 21, and plate-shaped portion 29 bent toward plate-shaped portion 21 on the opposite side from plate-shaped portion 22. Plate-shaped portion 21, plate-shaped portion 22 and plate-shaped portion 29 are the portions constituting metal plate 25 explained with reference to FIG. 7 (*a*) to FIG. 7 (*c*). Plate-shaped portion 21 in terminal electrode 20 is fixed to side face 12E of flange portion 12 by bonded portion 60. Bonded portion 60 can consist of an epoxy resin-based adhesive or some other resin-based adhesive, and may consist also of a filler.

Plate-shaped portion 22 of terminal electrode 20 is not fixed to bottom face 16A of recessed portion 14A but makes movable contact with bottom face 16A at the leading end 22A. A gap 83 is formed between plate-shaped portion 22 of terminal electrode 20 and bottom face 16A in recessed portion 14A. Plate-shaped portion 29 of terminal electrode 20 is provided along lower face 12A of flange portion 12 but is not fixed to lower face 12A. The entire plate-shaped portion 29 of terminal electrode 20 makes movable contact with lower surface 12A of flange portion 12.

Joined portion 28 used to electrically connect conductive wire 71 to terminal electrode 20 is formed on plate-shaped portion 22 of terminal electrode 20. The gap 83 is formed between at least the area of the plate-shaped portion 22 of terminal electrode 20 in which the joined portion 28 has been provided and bottom face 16A of recessed portion 14A.

[Manufacturing Method]

The method used to manufacture coil component 100 will now be explained. FIG. 9 (*a*) to FIG. 11 (*c*) are diagrams showing the method for manufacturing the coil component in the first embodiment of the present invention. A drum core 10 is prepared as shown in FIG. 9 (*a*). For example, a binder can be mixed with a Ni—Zn ferrite material and the mixture compression molded to obtain a drum-shaped molded object. The molded object may be deburred if necessary. This molded object is then sintered at a predetermined firing temperature to form a drum core 10 having a winding core portion 11 and flange portions 12, 13. Recessed portions 14A, 14B are formed in upper face 12B of flange portion 12, and recessed portions 15A, 15B are formed in upper face 13B of flange portion 13. Also, as shown in FIG. 8, side face 12E of flange portion 12 comes into contact with virtual plane 1, and bottom face 16A of recessed portion 14A comes into contact with virtual plane 2 forming obtuse angle θ1 with virtual plane 1. Note that bottom face 16B of recessed portion 14B also comes into contact with a virtual plane intersecting virtual plane 1 at an obtuse angle. The same applies to bottom faces 18A, 18B of recessed portions 15A, 15B.

As shown in FIG. 9 (*b*), a frame 90 is prepared which has metal terminal plate 24, metal terminal plate 34, and a connecting portion 91 connecting metal terminal plate 24 and metal terminal plate 34. Metal terminal plate 24 has plate-shaped portion 21 as well as plate-shaped portion 22 and plate-shaped portion 29 bent in the same direction, that is, toward plate-shaped portion 21 but from opposite sides of plate-shaped portion 21. Similarly, metal terminal plate 34 has plate-shaped portion 31 as well as plate-shaped portion 32 and plate-shaped portion 39 bent in the same direction, that is, toward plate-shaped portion 31 but from opposite sides of plate-shaped portion 31. A plurality of metal terminal plates 24 and a plurality of metal terminal plates 34 are connected by connecting portions 91 in frame 90.

As shown in FIG. 10 (*a*), adhesive 84 is applied to plate-shaped portion 21 of metal terminal plate 24 and plate-shaped portion 31 of metal terminal plate 34. In the present embodiment, the adhesive 84 is applied at several points. However, it may be applied in other ways such as over the surface. The adhesive is not applied to plate-shaped portion 22 and plate-shaped portion 29 of metal terminal plate 24 or to plate-shaped portion 32 and plate-shaped portion 39 of metal terminal plate 34.

As shown in FIG. 10 (*b*), flange portion 12 of drum core 10 is pressed against frame 90 and flange portion 12 is fixed to metal terminal plates 24 and 34 by bonded portions 60 consisting of the adhesive 84. Here, the step of fixing metal terminal plates 24, 34 to flange portion 12 will be explained in detail. FIG. 12 (*a*) to FIG. 12 (*c*) are cross-sectional views showing the steps for assembling a metal terminal plate on a flange portion in the first embodiment of the present invention. Because metal terminal plate 34 is fixed to flange portion 12 in the same manner as metal terminal plate 24, an explanation is provided of metal terminal plate 24 only and an explanation of metal terminal plate 34 has been omitted.

As shown in FIG. 12 (*a*), the adhesive 84 is applied only to plate-shaped portion 21 among plate-shaped portion 21, plate-shaped portion 22, and plate-shaped portion 29 of metal terminal plate 24. As shown in FIG. 12 (*b*), flange portion 12 is pressed against metal terminal plate 24. As shown in FIG. 12 (*c*), plate-shaped portion 21 of metal terminal plate 24 is fixed to side face 12E of flange portion 12 by a bonded portion 60 of cured adhesive 84 so that leading end 22A of plate-shaped portion 22 in metal terminal plate 24 makes movable contact with bottom face 16A of recessed portion 14A formed in flange portion 12 and so that plate-shaped portion 29 of metal terminal plate 24 makes movable contact with lower face 12A of flange portion 12.

While not depicted in the figures, metal terminal plates 44, 54 are fixed to flange portion 13 using the same method used to fix metal terminal plates 24, 34 after metal terminal plates 24, 34 have been fixed to flange portion 12.

A drum core 10 with assembled metal terminal plates 24, 34, 44, 54 is separated from the frame 90 to form an individual unit as shown in FIG. 11 (*a*).

As shown in FIG. 11 (*b*), conductive wires 71, 72 are wound the necessary number of times around the winding core portion 11 of the drum core 10 to form a coil portion 70. Conductive wire 71 and conductive wire 72 are wound the same number of times. The end of conductive wire 71 is drawn over metal terminal plates 24, 44 and the end of conductive wire 72 is drawn over metal terminal plates 34, 54.

As shown in FIG. 11 (*c*), engaging claw 26 on metal terminal plate 24 and engaging claw 46 on metal terminal plate 44 are bent to secure conductive wire 71, and then one end of conductive wire 71 is welded to joining claw 27 on metal terminal plate 24 to form joined portion 28, and the other end of conductive wire 71 is welded to joining claw 47 on metal terminal plate 44 to form a joined portion (not shown). In this way, conductive wire 71 is connected electrically to metal terminal plates 24 and 44. Similarly, engaging claw 36 on metal terminal plate 34 and engaging claw 56 on metal terminal plate 54 are bent to secure conductive wire 72, and then one end of conductive wire 72 is welded to joining claw 37 on metal terminal plate 34 to form joined portion 38, and the other end of conductive wire 72 is welded to joining claw 57 on metal terminal plate 54 to form a joined portion (not shown). In this way, conductive wire 72 is connected electrically to metal terminal plates 34 and 54. Afterwards, plate core 80 is secured to upper face 12B of flange portion 12 and to upper face 13B of flange portion 13 using, for example, an adhesive.

In coil component 100, as shown in FIG. 8, side face 12E (the first surface) of flange portion 12 of the drum core 10 (the base portion) comes into contact with virtual plane 1 (the first virtual plane), and bottom face 16A (the second surface) of recessed portion 14A comes into contact with virtual plane 2 intersecting virtual plane 1 (the second virtual plane) at obtuse angle θ1. Plate-shaped portion 21 (the first portion) of terminal electrode 20 (the first terminal electrode) is fixed to side face 12E of flange portion 12 by a bonded portion 60, and plate-shaped portion 22 (the second portion) of terminal electrode 20 comes into movable contact with bottom face 16A of recessed portion 14A at the leading end 22A. Because terminal electrode 20 and bonded portion 60 have different coefficients of linear thermal expansion in response to heat, they experience thermal expansion at different rates in response to heat during component assembly such as from curing during the bonding process or from the laser joining, heat during component mounting such as from reflow and molding, heat generated by the coil component itself during use, and/or heat due to changes in the ambient temperature. Even though terminal electrode 20 and bonded portion 60 experience thermal expansion at different rates, the difference is absorbed on the plate-shaped portion 22 side of terminal electrode 20 because the leading end 22A of plate-shaped portion 22 in terminal electrode 20 makes movable contact with bottom face 16A of recessed portion 14A, and peeling of terminal electrode 20 from flange portion 12 is prevented. Because terminal electrode 20 is flexible at the bent portion of metal terminal plate 24, the leading end 22A of plate-shaped portion 22 remains in contact with bottom face 16A of recessed portion 14A even when the temperature of coil component 100 changes. Because the leading end 24A of plate-shaped portion 22 remains in contact with bottom face 16A, the mechanical strength of terminal electrode 20 is improved.

Also, as shown in FIG. 12 (*c*), flange portion 12 of drum core 10 is pressed against metal terminal plate 24, and plate-shaped portion 21 (the first portion) of metal terminal plate 24 is fixed by a bonded portion 60 to side face 12E (the first surface) of flange portion 12 with the leading end 22A of plate-shaped portion 22 (the second portion) of metal terminal plate 24 making contact with bottom face 16A (the second surface) of recessed portion 14A. By establishing contact between the leading end 22A of plate-shaped portion 22 of terminal electrode 20 and bottom face 16A of recessed portion 14A in this way, the position of metal terminal plate 24 is set with respect to flange portion 12 in the X direction in FIG. 12 (*c*). As a result, the precision with which terminal electrode 20 is assembled on flange portion 12 can be improved. Because leading end 22A of plate-shaped portion 22 in terminal electrode 20 makes contact with bottom face 16A of recessed portion 14A, the thermal conductivity between coil components 100 and between terminal electrode 20 and flange portion 12 is about the same.

In coil component 100, as shown in FIG. 8, side face 12E of flange portion 12 makes contact with virtual plane 1, bottom surface 16A of recessed portion 14A makes contact with virtual plane 2 intersecting virtual plane 1, and bottom face 12A (the third surface) of flange portion 12 makes contact with virtual plane 3 (the third virtual plane) intersecting virtual plane 1. In terminal electrode 20, the leading end 22A of plate-shaped portion 22 makes movable contact with bottom face 16A of recessed portion 14A, and plate-shaped portion 29 (the third portion) makes movable contact with lower face 12A of flange portion 12. In this structure, as shown in FIG. 12 (*c*), flange portion 12 is pressed against metal terminal plate 24 and plate-shaped portion 21 of metal terminal plate 24 is fixed to side face 12E of flange portion 12 by bonded portion 60 with leading end 22A of plate-shaped portion 22 of metal terminal plate 24 making movable contact with bottom face 16A of recessed portion 14A and with plate-shaped portion 29 (the third portion) of metal terminal plate 24 making movable contact with lower face 12A (the third surface) of flange portion 12. In this way, the position of metal terminal plate 24 with respect to flange portion 12 is set in the X direction and Z direction in FIG. 12 (*c*). As a result, the precision with which terminal electrode 20 is assembled on flange portion 12 can be improved.

As shown in FIG. 8, angle θ3 between the surface of plate-shaped portion 21 of terminal electrode 20 on the flange portion 12 side and the surface of plate-shaped portion 22 on the flange portion 12 side is preferably smaller than angle θ1 formed by virtual plane 2 intersecting virtual plane 1. In this way, only the leading end 22A of plate-shaped portion 22 of terminal electrode 20 can make sliding contact with bottom face 16A of recessed portion 14A. As a result, when the difference between the thermal expansion of terminal electrode 20 and bonded portion 60 is significant, plate-shaped portion 22 of terminal electrode 20 readily moves to absorb the difference in thermal expansion. This keeps terminal electrode 20 from peeling off flange portion 12. By also setting the position of metal terminal plate 24 with respect to flange portion 12 in the X direction in FIG. 8, the precision with which terminal electrode 20 is assembled on flange portion 12 is improved.

As shown in FIG. 8, terminal electrode 20 has a joined portion 28 at which metal terminal plate 24 and conductive wire 71 (conductor) are joined to plate-shaped portion 22. In this way, the localized heat during formation of the joined portion 28 using a laser or heater is not transmitted to flange portion 12. This keeps flange portion 12 from cracking and prevents changes in the magnetic characteristics of flange portion 12. In order to keep heat from the formation of joined portion 28 from being transmitted to flange portion 12, a gap 83 is preferably formed between the area of the plate-shaped portion 22 of terminal electrode 20 in which at least joined portion 28 is formed and bottom face 16A of recessed portion 14A.

Drum core 10 includes a magnetic material, terminal electrode 20 includes copper, and bonded portion 60 consists of a resin-based adhesive. Here, the coefficient of linear thermal expansion of bonded portion 60 is greater than that of flange portion 12 and terminal electrode 20. (The coefficient of linear thermal expansion for ferrite is about $1.2\times10^{-5}$/K, the coefficient of linear thermal expansion for copper is about $1.6\times10^{-5}$/K, and the coefficient of linear thermal expansion for epoxy resin is about $5.9\times10^{-5}$/K.) Therefore, as the temperature of coil component 100 rises, thermal expansion of bonded portion 60 increases relative to that of flange portion 12 and terminal electrode 20. As a result, the terminal electrode 20 is more likely to peel off from flange portion 12. In this situation, use of the configuration of the present invention is preferred.

Angle θ1 between virtual plane 1 and virtual plane 2 is preferably greater than 90° and less than 100°. When angle θ1 is greater than 100°, the gap 83 between plate-shaped portion 22 of terminal electrode 20 and flange portion 12 increases. As a result, flange portion 12 becomes smaller and the magnetic paths more restricted. This causes deterioration in electrical characteristics such as a decrease in the L value.

By setting the angle θ1 between virtual plane 1 and virtual plane 2 to a right angle and setting angle θ3 between plate-shaped portion 21 and plate-shaped portion 22 of terminal electrode 20 to less than 90°, the leading end 22A of plate-shaped portion 22 can be brought into contact with bottom face 16A of recessed portion 14A. However, a structure in which metal terminal plate 24 is bent so that angle θ3 is less than 90° and so that the leading end 22A of plate-shaped portion 22 can be brought into contact with bottom face 16A of recessed portion 14A is difficult to produce because it can be difficult to bend the plate at a stable angle θ3 without variation. Therefore, the leading end 22A of plate-shaped portion 22 is preferably brought into contact with bottom face 16A of recessed portion 14A using an obtuse angle θ1 as in the present invention.

2nd Embodiment

FIG. 13 is a cross-sectional view of the coil component in the second embodiment of the present invention near a terminal electrode. Because the shape near terminal electrode 20 is the same near terminal electrodes 30, 40 and 50, a description of the shape near terminal electrode 20 will be provided and a description of the shape near terminal electrodes 30, 40 and 50 will be omitted. As shown in FIG. 13, flange portion 12 has a notch 85 in side face 12E in the area overlapping with terminal electrode 20 and bottom face 16A of recessed portion 14A in the corner portion formed by virtual plane 1 and virtual plane 2. The rest of the configuration of the coil component in the second embodiment is the same as that of coil component 100 in the first embodiment so further description has been omitted.

FIG. 14 (*a*) and FIG. 14 (*b*) are diagrams used to explain the effect of the coil component in the second embodiment of the present invention. When metal terminal plate 24 is bent, there is sometimes variation in the curvature of the curved shape. When the curvature of the curved shape of metal terminal plate 24 is great, metal terminal plate 24 comes into contact with flange portion 12 in the corner when a notch 85 has not been formed in flange portion 12 as shown in FIG. 14 (*a*), and the leading end 22A of plate-shaped portion 22 of metal terminal plate 24 does not come into contact with bottom face 16A in recessed portion 14A and/or the interval between plate-shaped portion 21 of metal terminal plate 24 and side face 12E of flange portion 12 increases and plate-shaped portion 21 cannot be bonded to side face 12E by a bonded portion 60. When a notch 85 is formed in flange portion 12 as shown in FIG. 14 (*b*), metal terminal plate 24 is kept from coming into contact with flange portion 12 in the corner. This prevents a situation in which the leading end 22A of plate-shaped portion 22 of metal terminal plate 24 does not come into contact with bottom face 16A in recessed portion 14A and/or plate-shaped portion 21 of metal terminal plate 24 cannot be bonded to side face 12E of flange portion 12 by a bonded portion 60.

3rd Embodiment

FIG. 15 is a cross-sectional view of the coil component in the third embodiment of the present invention near a terminal electrode. Because drum core 10 is assembled for terminal electrodes 30, 40 and 50 in the same manner as terminal electrode 20, a description for terminal electrode 20 will be provided and a description for terminal electrodes 30, 40 and 50 will be omitted. As shown in FIG. 15, angle θ2 formed by virtual plane 3 intersecting virtual plane 1 is an obtuse angle so that only leading end 29A of plate-shaped portion 29 of terminal electrode 20 is able to make movable contact with lower face 12A of flange portion 12. A gap 86 is formed between plate-shaped portion 29 of terminal electrode 20 and lower face 12A of flange portion 12. The rest of the configuration of the coil component in the third embodiment is the same as that of coil component 100 in the first embodiment so further description has been omitted.

FIG. 16 (*a*) to FIG. 16 (*c*) are cross-sectional views showing the steps for assembling a metal terminal plate on a flange portion in the third embodiment of the present invention. Because metal terminal plates 34, 44 and 54 are fixed to flange portions 12 and 13 in the same manner as metal terminal plate 24, a description for metal terminal plate 24 will be provided and a description for metal terminal plates 34, 44 and 54 will be omitted.

As shown in FIG. 16 (*a*), adhesive 84 is applied only to plate-shaped portion 21 among plate-shaped portion 21, plate-shaped portion 22, and plate-shaped portion 29 of metal terminal plate 24. As shown in FIG. 16 (*b*), flange portion 12 of drum core 10 is pressed against metal terminal plate 24 beforehand. For flange portion 12, as shown in FIG. 15, angle θ1 between virtual plane 1 making contact with side face 12E and virtual plane 2 making contact with bottom face 16A of recessed portion 14A is an obtuse angle, and angle θ2 formed between virtual plane 1 and virtual plane 3 making contact with lower face 12A is an obtuse angle. As shown in FIG. 16 (*c*), plate-shaped portion 21 of metal plate terminal 24 is fixed to side face 12E of flange portion 12 by a bonded portion 60 consisting of cured adhesive 84 with the leading end 22A of plate-shaped portion 22 of metal terminal plate 24 in movable contact with bottom face 16A of recessed portion 14A and plate-shaped portion 29 of metal terminal plate 24 in movable contact with lower face 12A of flange portion 12.

In the third embodiment, angle θ2 formed by virtual plane 3 intersecting virtual plane 1 is an obtuse angle in addition to obtuse angle θ1 formed by virtual plane 2 intersecting virtual plane 1. In terminal electrode 20, leading end 22A of plate-shaped portion 22 is in movable contact with bottom face 16A of recessed portion 14A and the leading end 29A of plate-shaped portion 29 is in movable contact with lower face 12A of flange portion 12. Therefore, when the difference in thermal expansion between terminal electrode 20 and bonded portion 60 is great, plate-shaped portion 22 and plate-shaped portion 29 of terminal electrode 20 easily move to absorb the difference in thermal expansion. This can keep terminal electrode 20 from peeling off flange portion 12.

As shown in FIG. 16 (*c*), flange portion 12 is pressed against metal terminal plate 24 and plate-shaped portion 21 of metal terminal plate 24 is fixed to side face 12E of flange portion 12 by bonded portion 60 with leading end 22A of plate-shaped portion 22 of metal terminal plate 24 making movable contact with bottom face 16A of recessed portion 14A and with leading end 29A of plate-shaped portion 29 of metal terminal plate 24 making movable contact with lower face 12A of flange portion 12. In this way, the position of metal terminal plate 24 can be easily set with respect to flange portion 12 in two directions, the X direction and the Z direction in FIG. 16 (*c*). In contrast to the first embodiment, in which the position of metal terminal plate 24 is set with respect to flange portion 12 in only the X direction, the third embodiment sets the position of metal terminal plate 24 with respect to flange portion 12 in two directions, the X direction and the Z direction. As a result, the precision with which terminal electrode 20 is assembled on flange portion 12 can be improved.

Because, as shown in FIG. 15, a gap 86 is formed between lower face 12A of flange portion 12 and plate-shaped portion 29 of terminal electrode 20, heat is less likely to be transmitted to flange portion 12 when the coil component is mounted on a circuit board by soldering. This keeps flange portion 12 from cracking and prevents changes in the magnetic characteristics of flange portion 12.

In the third embodiment, as in the second embodiment, flange portion 12 may have a notch 85 in side face 12E in the area overlapping with terminal electrode 20 and bottom face 16A of recessed portion 14A in the corner portion formed by virtual plane 1 and virtual plane 2. Flange portion 12 may also have a notch in side face 12E in the area overlapping with terminal electrode 20 and lower face 12A in the corner portion formed by virtual plane 1 and virtual plane 3.

4th Embodiment

FIG. 17 (*a*) and FIG. 17 (*b*) are cross-sectional views of the coil component in the fourth embodiment of the present invention and a modified example of the same near a terminal electrode. Because drum core 10 is assembled for terminal electrodes 30, 40 and 50 in the same manner as terminal electrode 20, a description for terminal electrode 20 will be provided and a description for terminal electrodes 30, 40 and 50 will be omitted.

In the first embodiment to the third embodiment, terminal electrode 20 is U-shaped from lower face 12A of flange portion 12 via side face 12E to bottom face 16A of recessed portion 14A. However, the present invention is not limited to this configuration. As shown in FIG. 17 (*a*), terminal electrode 20 may be L-shaped from side face 12E of flange portion 12 to bottom face 16A of recessed portion 14A. In this structure, the position of metal terminal plate 24 is determined with respect to flange portion 12 in the X direction. As a result, when the difference between the thermal expansion of terminal electrode 20 and bonded portion 60 is significant, plate-shaped portion 22 of terminal electrode 20 readily moves to absorb the difference in thermal expansion. This keeps terminal electrode 20 from peeling off flange portion 12. Also, as shown in FIG. 17 (*b*), plate-shaped portion 22 of terminal electrode 20 may be fixed to bottom face 16A of recessed portion 14A by bonded portion 60 with the leading end 21A of plate-shaped portion 21 of terminal electrode 20 in movable contact with side face 12E of flange portion 12 inclined with respect to bottom face 16A. In this structure, the position of metal terminal plate 24 is determined with respect to flange portion 12 in the Z direction. As a result, when the difference between the thermal expansion of terminal electrode 20 and bonded portion 60 is significant, plate-shaped portion 21 of terminal electrode 20 readily moves to absorb the difference in thermal expansion. This keeps terminal electrode 20 from peeling off flange portion 12.

In the fourth embodiment, as in the second embodiment, flange portion 12 may have a notch 85 in side face 12E in the area overlapping with terminal electrode 20 and bottom face 16A of recessed portion 14A in the corner portion formed by virtual plane 1 and virtual plane 2.

5th Embodiment

FIG. 18 (*a*) is a perspective view of the coil component in the fifth embodiment of the present invention, and FIG. 18 (*b*) is a cross-sectional view of the coil component in the fifth embodiment of the present invention. As shown in FIG. 18 (*a*) and FIG. 18 (*b*), coil component 200 includes a base portion 110, a coil portion 170 composed of an internal conductor 171, and terminal electrodes 120 and 130. Base portion 110 has lower face 110A, upper face 110B, end face 110C, end face 110D, side face 110E, and side face 110F. Base portion 110 can be an aggregate, for example, of soft magnetic particles bonded to each other with an oxide film formed on the soft magnetic particles. Terminal electrode 120 is composed of a metal terminal plate 124 extending from lower face 110A to end face 110C and assembled on base portion 110. Terminal electrode 130 is composed of a metal terminal plate 134 extending from lower face 110A to end face 110D and assembled on base portion 110. Metal terminal plates 124 and 134 can be tin-plated phosphor bronze.

The internal conductor 171 provided inside the base portion 110 consists of a core portion 170 wound in a spiral shape. The internal conductor 171 can be made of silver, copper, or an alloy whose main component is silver or copper. The internal conductor 171 is connected at one end to terminal electrode 120 and on the other end to terminal electrode 130.

Lower face 110A of base portion 110 makes contact with virtual plane 101, end face 110C makes contact with virtual plane 102, and end face 110D makes contact with virtual plane 103. Virtual plane 101 and virtual plane 102 intersect, and the angle θ1 at which virtual plane 102 intersects virtual plane 101 is an obtuse angle. Virtual plane 101 and virtual plane 103 intersect, and the angle θ2 at which virtual plane 103 intersects virtual plane 101 is an obtuse angle.

Terminal electrode 120 has a plate-shaped portion 121 along lower face 110A of base portion 110 and a plate-shaped portion 122 bent toward plate-shaped portion 121. Plate-shaped portion 121 is fixed to lower face 110A of base portion 110 by a bonded portion 160. Plate-shaped portion 122 is not fixed to end portion 110C of base portion 110 but makes movable contact with end face 110C at the leading end 122A.

Terminal electrode 130 has a plate-shaped portion 131 along lower face 110A of base portion 110 and a plate-shaped portion 132 bent toward plate-shaped portion 131. Plate-shaped portion 131 is fixed to lower face 110A of base portion 110 by a bonded portion 161. Plate-shaped portion 132 is not fixed to end portion 110D of base portion 110 but makes movable contact with end face 110D at the leading end 132A.

[Manufacturing Method]

FIG. 19 (*a*) to FIG. 19 (*c*) are diagrams showing the method for manufacturing the coil component in the fifth embodiment of the present invention. As shown in FIG. 19 (*a*), a frame 190 is prepared which has metal terminal plate 124, metal terminal plate 134, and a connecting portion 191 connecting metal terminal plate 124 and metal terminal plate 134. Metal terminal plate 124 has plate-shaped portion 121 and plate-shaped portion 122 bent toward plate-shaped portion 121. Similarly, metal terminal plate 134 has plate-shaped portion 131 and plate-shaped portion 132 bent toward plate-shaped portion 131. A plurality of metal terminal plates 124 and a plurality of metal terminal plates 134 are connected by connecting portions 191 in frame 190.

As shown in FIG. 19 (*b*), adhesive 184 is applied to plate-shaped portion 121 of metal terminal plate 124 and plate-shaped portion 131 of metal terminal plate 134. The adhesive is not applied to plate-shaped portion 122 of metal terminal plate 124 or to plate-shaped portion 132 of metal terminal plate 134.

As shown in FIG. 19 (*c*), base portion 110 is pressed against frame 190 and base portion 110 is fixed to metal terminal plates 124 and 134 by bonded portions 160 and 161 consisting of the adhesive 184. At this time, plate-shaped portion 121 of metal terminal plate 124 and plate-shaped portion 131 of metal terminal plate 134 are fixed to lower face 110A of base portion 110 by bonded portions 160 and 161 consisting of cured adhesive 184 so that leading end 122A of plate-shaped portion 122 of metal terminal plate 124 makes movable contact with end face 110C of base portion 110 and so that leading end 132A of plate-shaped portion 132 of metal terminal plate 134 makes movable contact with end face 110D of base portion 110. Afterwards, base portion 110 is separated from the frame 190 to form an individual unit. Because the base portion 110 containing a coil portion 170 consisting of an internal conductor 171 is formed using a well-known method (such as the lamination method), further description of this component has been omitted.

In coil component 200, angle θ1 between virtual plane 101 (the first virtual plane) making contact with lower face 110A (the first surface) of base portion 110 and virtual plane 102 (the second virtual plane) making contact with end face 110C (the second surface) is an obtuse angle. Angle θ2 between virtual plane 101 (virtual plane 3B) making contact with lower face 110A (surface 3B) of base portion 110 and virtual plane 103 (virtual plane 4B) making contact with end face 110D (surface 4B) is an obtuse angle. Plate-shaped portion 121 (the first portion) of terminal electrode 120 is fixed to lower face 110A of base portion 110 by bonded portion 160, and plate-shaped portion 122 (the second portion) bent toward plate-shaped portion 121 makes movable contact with end face 110C of base portion 110 at the leading end 122A. Plate-shaped portion 131 (portion 3B) of terminal electrode 130 is fixed to lower face 110A of base portion 110 by bonded portion 161, and the leading end 132A of plate-shaped portion 132 (portion 4B) bent toward plate-shaped portion 131 makes movable contact with end face 110D of base portion 110. Because terminal electrode 120 and bonded portion 160 have different coefficients of linear thermal expansion in response to heat, they experience thermal expansion at different rates in response to heat during component assembly such as from curing during the bonding process or from the laser joining, heat during component mounting such as from reflow and molding, heat generated by the coil component itself during use, and/or heat due to changes in the ambient temperature. Even though terminal electrode 120 and bonded portion 160 experience thermal expansion at different rates, the difference is absorbed on the plate-shaped portion 122 side of terminal electrode 120, and peeling of terminal electrode 120 from base portion 110 is prevented. Similarly, even though terminal electrode 130 and bonded portion 161 experience thermal expansion at different rates, the difference is absorbed on the plate-shaped portion 132 side of terminal electrode 130, and peeling of terminal electrode 130 from base portion 110 is prevented.

As shown in FIG. 19 (*a*), frame 190 is prepared in which metal terminal plate 124 and metal terminal plate 134 are connected by connecting portion 191. As shown in FIG. 19 (*c*), base portion 110 is pressed against frame 190 with the leading end 122A of plate-shaped portion 122 (the second portion) of terminal plate 124 (the first metal terminal plate) making movable contact with end face 110C (the second surface) of base portion 110 and with the leading end 132A of plate-shaped portion 132 (portion 4B) of terminal plate 134 (the second metal terminal plate) making movable contact with end face 110D (surface 4B) of base portion 110. In this state, plate-shaped portion 121 (the first portion) of metal terminal plate 124 and plate-shaped portion 131 (portion 3B) of metal terminal plate 134 are fixed to lower face 110A (the first surface and surface 3B) of base portion 110 by bonded portions 160 and 161. Because the leading end 122A of plate-shaped portion 122 in terminal electrode 120 makes movable contact with end face 110C of base portion 110 and the leading end 132A of plate-shaped portion 132 in terminal electrode 130 makes movable contact with end face 110D of base portion 110, the position of metal terminal plate 124 and 134 is set with respect to base portion 110 in the X direction and in the Z direction of FIG. 19 (*c*). In this way, the precision with which terminal electrodes 120 and 130 are assembled on base portion 110 can be improved.

In the fifth embodiment, the first virtual plane and the third virtual plane are the same. However, the first virtual plane and the third virtual plane may also be different. For example, lower face 110A of base portion 110 may be tiered.

6th Embodiment

FIG. 20 is a perspective view of an electronic device including the coil component in the first embodiment of the present invention. As shown in FIG. 20, electronic device 300 includes a circuit board 310 and a coil component 100 mounted on the circuit board 310. Coil component 100 is mounted on the circuit board 310 by joining terminal electrodes 20, 30, 40 and 50 to electrode 312 on the circuit board 310 by solder 314. An electronic device 300 including a circuit board 310 and a coil component 100 mounted on the circuit board 310 is less likely to experience defects and disconnection due to electrode peeling in the coil component 100 in response to heat generated by the coil component itself during use and/or heat due to changes in the ambient temperature. In FIG. 20, the coil component 100 in the first embodiment is mounted on the circuit board 310. However, a coil component from the second embodiment to the fifth embodiment may be mounted as well.

Embodiments of the present invention were described in detail above, but the present invention is not limited to any particular embodiment and various changes and modifications are possible within the scope of the present invention described in the claims.

KEY TO THE DRAWINGS

1, 2, 3 Virtual planes
10 Drum core
11 Winding core portion
12, 13 Flange portions
12A, 13A Lower faces
12B, 13B Upper faces
12C, 12D, 13C, 13D End faces
12E, 12F, 13E, 13F Side faces
14A, 14B, 15A, 15B Recessed portions
16A, 16B, 18A, 18B Bottom faces
17A, 17B, 19A, 19B Side faces
20, 30, 40, 50 Terminal electrodes
21, 22, 29, 31, 32, 39 Plate-shaped portions
21A, 22A, 29A Leading ends
24, 34, 44, 54 Metal terminal plates
25, 35, 45, 55 Metal plates
26, 36, 46, 56 Engaging claws
27, 37, 47, 57 Joining claws
28, 38 Joined portions
60 Bonded portion
70 Coil portion
71, 72 Conductive wires
80 Plate core
83, 86 Gaps
84 Adhesive

85 Notch
90 Frame
91 Connecting portion
100 Coil component
110 Base portion
110A Lower face
110B Upper face
110C, 110D End faces
110E, 110F Side faces
120, 130 Terminal electrodes
121, 122, 131, 132 Plate-shaped portions
122A, 132A Leading ends
124, 134 Metal terminal plates
160, 161 Bonded portions
170 Coil portion
171 Internal conductor
184 Adhesive
190 Frame
191 Connecting portion
200 Coil component
201, 202 Virtual planes
210 Base portion
211, 212 Surfaces
220 Terminal electrode
221, 222 Plate-shaped portions
222A Leading ends
224 Metal terminal plate
260 Bonded portion
300 Electronic device
310 Circuit board
312 Electrode
314 Solder

The invention claimed is:

1. A coil component comprising:

a base portion having a first surface and a second surface connected to the first surface, a first virtual plane including the first surface and a second virtual plane including the second surface intersecting at an obtuse first angle;

a coil portion formed by a conductor wound around the base portion; and a first terminal electrode connected electrically to the coil portion, the first terminal electrode being made of a plate-shaped first metal plate having a first portion fixed to the first surface of the base portion by a first bonded portion, and a second portion bent with respect to the first portion and coming into contact at the leading end with the second surface of the base portion, wherein a first air gap is formed between the second surface of the base portion and the second portion of the first terminal electrode, and wherein a first face of the first portion and a second face of the second portion respectively face the first surface and the second surface of the base portion, and a second angle formed by an intersection of the first and second faces is smaller than the first angle.

2. A coil component according to claim 1, wherein the second portion of the first terminal electrode has a joined portion connected electrically to the coil portion.

3. A coil component according to claim 2, wherein the first terminal electrode and the base portion have the first air gap formed between the rear surface area of the face in the second portion of the first terminal electrode provided with at least the joined portion and the second surface of the base portion.

4. A coil component according to claim 1, wherein the base portion has a notch in the first surface and the second surface in the area overlapping with the first terminal electrode in a corner portion formed by the intersecting first virtual plane and second virtual plane.

5. A coil component according to claim 1, wherein the base portion contains a magnetic material, the first terminal electrode contains copper, and the first bonded portion contains a resin-based adhesive.

6. A coil component according to claim 1, wherein the base portion has a third surface connected to the first surface on the opposite side from the second surface, a third virtual plane including the third surface intersects the first virtual plane, and the first metal plate has a third portion bent with respect to the first portion on the opposite side from the second portion and coming into contact at the leading end with the third surface of the base portion.

7. A coil component according to claim 6, wherein a third angle formed by the third virtual plane intersecting the first virtual plane is an obtuse angle, the third portion comes into contact at the leading end with the third surface of the base portion, and a second air qap is formed between the third surface of the base portion and the third portion of the first terminal electrode.

8. A coil component according to claim 1, wherein the base portion has a third surface and a fourth surface connected to the third surface on the opposite side from the second surface, a third virtual plane including the third surface intersects a fourth virtual plane including the fourth surface at obtuse angle third, and the coil component comprises a second terminal electrode made of a plate-shaped second metal plate having a third portion fixed to the third surface of the base portion by a second bonded portion, and a fourth portion bent towards the third portion and coming into contact at the leading end with the fourth surface of the base portion.

9. An electronic device comprising a coil component according to claim 1, and a circuit board on which the coil component is mounted.

10. The coil component according to claim 1, wherein the second portion is in movable contact with the second surface of the base portion.

11. A method for manufacturing a coil component, the method comprising the steps of:

preparing a base portion having a first surface and a second surface connected to the first surface, a first virtual plane including the first surface and a second virtual plane including the second surface intersecting at an obtuse first angle;

preparing a metal terminal plate having a first portion and a second portion bent toward the first portion; and pressing the base portion against the metal terminal portion to fix the first surface of the base portion to the first portion of the metal terminal plate in the first bonded portion so the leading end of the second portion of the metal terminal plate comes into contact with the second surface of the base portion, wherein a first air gap is formed between the second surface of the base portion and the second portion of the first terminal electrode, and wherein a first face of the first portion and a second face of the second portion respectively face the first surface and the second surface of the base portion, and a second angle formed by an intersection of the first and second faces is smaller than the first angle.

12. A method for manufacturing a coil component according to claim 11, wherein in the step of preparing the base portion, the base portion has a third surface connected to the first surface on the opposite side from the second surface, and a third virtual plane including the third surface intersects the first virtual plane, in the step of preparing the metal terminal plate, the metal terminal plate has a third portion bent toward the first portion on the opposite side from the second portion, and in the fixing step, the base portion is pressed against the metal terminal portion in the fixing process so the leading end of the third portion of the metal terminal plate comes into contact at the leading end with the third surface of the base portion.

13. A method for manufacturing a coil component according to claim 12, wherein in the step of preparing the base portion, the base portion is prepared so that the angle formed by the third virtual plane intersecting the first virtual plane is an obtuse angle.

14. A method for manufacturing a coil component, the method comprising the steps of:

preparing a base portion having a first surface, a second surface connected to the first surface, a third surface, and a fourth surface connected to the third surface on the opposite side from the second surface, a first virtual plane including the first surface and a second virtual plane including the second surface intersecting at an obtuse first angle and a third virtual plane including the third surface intersecting a fourth virtual plane including the fourth surface at obtuse angle third;

preparing a frame having a first metal terminal plate having a first portion and a second portion bent toward the first portion, a second metal terminal plate having a third portion and a fourth portion bent toward the third portion, and a connecting portion connecting the first metal terminal plate and the second metal terminal plate; and pressing the base portion against the frame to fix the first surface of the base portion to the first portion of the first metal terminal plate in a first bonded portion so the leading end of the second portion of the first metal terminal plate comes into contact with the second surface of the base portion, and fixing the third surface of the base portion to the third portion of the second metal terminal plate in a second bonded portion so the leading end of the fourth portion of the second metal terminal plate comes into contact with the fourth surface of the base portion, wherein a first air gap is formed between the second surface of the base portion and the second portion of the first metal terminal plate.

* * * * *